US006871927B2

(12) United States Patent
Oikawa

(10) Patent No.: US 6,871,927 B2
(45) Date of Patent: Mar. 29, 2005

(54) IMAGE PRINTING APPARATUS AND CONTROL METHOD THEREFOR

(75) Inventor: Masaki Oikawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/648,314

(22) Filed: Aug. 27, 2003

(65) Prior Publication Data

US 2004/0041864 A1 Mar. 4, 2004

Related U.S. Application Data

(62) Division of application No. 10/150,917, filed on May 22, 2002, now Pat. No. 6,648,439.

(30) Foreign Application Priority Data

May 24, 2001 (JP) ..... 2001-155988

(51) Int. Cl.[7] ..... B41J 29/38

(52) U.S. Cl. ..... 347/11; 347/10; 347/17; 347/60

(58) Field of Search ..... 347/10, 11, 17, 347/19, 60, 9, 12

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,736,994 A | * | 4/1998 | Takahashi | 347/11 |
| 5,861,895 A | | 1/1999 | Tajika et al. | 347/14 |
| 5,896,146 A | | 4/1999 | Murata et al. | 347/42 |
| 6,116,710 A | | 9/2000 | Tajika et al. | 347/14 |
| 6,257,688 B1 | | 7/2001 | Kubo | 347/11 |
| 6,296,340 B1 | | 10/2001 | Tajika et al. | 347/12 |
| 6,312,076 B1 | | 11/2001 | Taki et al. | 347/10 |
| 6,328,407 B1 | | 12/2001 | Sengun | 347/17 |
| 6,406,112 B1 | | 6/2002 | Oikawa | 347/9 |

FOREIGN PATENT DOCUMENTS

| | | |
|---|---|---|
| EP | 0 630 751 | 12/1994 |
| EP | 0 730 962 | 9/1996 |
| JP | 59-123670 | 7/1984 |
| JP | 59-138461 | 8/1984 |
| JP | 5-31905 | 2/1993 |
| JP | 7-96608 | 4/1995 |
| JP | 9-11504 | 1/1997 |
| JP | 9-174847 | 7/1997 |
| JP | 11-170500 | 6/1999 |

* cited by examiner

*Primary Examiner*—Stephen D. Meier
*Assistant Examiner*—Lam Nguyen
(74) *Attorney, Agent, or Firm*—Fitzpatrick, Cella, Harper & Scinto

(57) ABSTRACT

This invention provides an image printing apparatus in which, when the printhead temperature rises in driving the printhead at a high speed, the ink discharge amount is optimized in accordance with the temperature rise to achieve high-quality, high-efficiency printing. For this purpose, in an image printing system using a time division simultaneous driving method of grouping a predetermined number of printing elements into a plurality of blocks every predetermined number of printing elements and driving printing elements belonging to the same block at the same driving timing, if the printhead falls within a predetermined temperature range, droplets are discharged using all blocks to print an image. To the contrary, if the printhead reaches the predetermined temperature or higher, blocks to be used are restricted in accordance with the printhead temperature, the total number of droplets is decreased, and the amount of one droplet is increased to print an image. High-quality, high-efficiency printing is realized as a whole.

4 Claims, 24 Drawing Sheets

FIG. 3

FIRST EMBODIMENT

PRINTHEAD TEMPERATURE-PRINTING MODE TABLE

| PRINTHEAD TEMPERATURE | 30°C OR LESS | 30°C TO 35°C | 36°C TO 40°C | 41°C OR MORE |
|---|---|---|---|---|
| PRINTING MODE | NORMAL MODE (DOUBLE-PULSE MODE) | NORMAL MODE (SINGLE-PULSE MODE) | DECIMATION MODE (n=2) | DECIMATION MODE (n=3) |

DOUBLE-PULSE DRIVING IN CONVENTIONAL PRINTHEAD

FIG. 7

| INPUT ORDER | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| CONTENTS | DATA0 | DATA1 | DATA2 | DATA3 | DATA4 | DATA5 | DATA6 | DATA7 | DATA8 | DATA9 | BE0 | BE1 | BE2 | BE3 | BE4 | DHE |

PRINTING DATA SIGNAL (HEATER-ON/OFF SIGNAL) → PRINTING DATA SIGNAL IS STORED IN 10-BIT SHIFT REGISTER

PRINTING BLOCK SIGNAL (REPRESENTING HEATER DRIVING BLOCK) → PRINTING BLOCK SIGNAL IS STORED IN 6-BIT SHIFT REGISTER

TIMING CHART OF DATA TRANSFER OF PRINTING DATA(PRINTING BIT) SIGNAL AND PRINTING BLOCK SIGNAL, AND DRIVING OF HEATER ELEMENT

FIG. 9

BLOCK DATA

| | DECODER INPUT | | | | DECODER OUTPUT | | | | | | | | | | |
|---|---|---|---|---|---|---|---|---|---|---|---|---|---|---|---|
| CODE | BE3 | BE2 | BE1 | BE0 | BLE15 | BLE14 | BLE13 | BLE12 | BLE11 | ····· | BLE4 | BLE3 | BLE2 | BLE1 | BLE0 |
| 0 | L | L | L | L | L | L | L | L | L | ····· | L | L | L | L | H |
| 1 | L | L | L | H | L | L | L | L | L | ····· | L | L | L | H | L |
| 2 | L | L | H | L | L | L | L | L | L | ····· | L | L | H | L | L |
| 3 | L | L | H | H | L | L | L | L | L | ····· | L | H | L | L | L |
| 4 | L | H | L | L | L | L | L | L | L | ····· | H | L | L | L | L |
| ⋮ | ⋮ | ⋮ | ⋮ | ⋮ | ⋮ | ⋮ | ⋮ | ⋮ | ⋮ | | ⋮ | ⋮ | ⋮ | ⋮ | ⋮ |
| 11 | H | L | H | H | L | L | L | L | H | ····· | L | L | L | L | L |
| 12 | H | H | L | L | L | L | L | H | L | ····· | L | L | L | L | L |
| 13 | H | H | L | H | L | L | H | L | L | ····· | L | L | L | L | L |
| 14 | H | H | H | L | L | H | L | L | L | ····· | L | L | L | L | L |
| 15 | H | H | H | H | H | L | L | L | L | ····· | L | L | L | L | L |

L : LOW(ACTIVE)
H: HIGH

12 DECODER OUTPUTS(USE)

FIG. 12A

DRIVING PULSE WIDTH TABLE

| | PULSE WIDTH | NORMAL DOUBLE-PULSE DRIVING | NORMAL SINGLE-PULSE DRIVING | DECIMATION MODE (n=2) | DECIMATION MODE (n=3) |
|---|---|---|---|---|---|
| FIRST BLOCK | P1[μsec] | 0.20 | 0.00 | 0.00 | 0.00 |
| | P2[μsec] | 0.20 | 0.00 | 0.00 | 0.00 |
| | P3[μsec] | 0.70 | 0.80 | 0.40 | 0.10 |
| SECOND BLOCK | P1[μsec] | — | — | 0.00 | 0.00 |
| | P2[μsec] | — | — | 0.20 | 0.10 |
| | P3[μsec] | — | — | 0.70 | 0.40 |
| THIRD BLOCK | P1[μsec] | — | — | — | 0.00 |
| | P2[μsec] | — | — | — | 0.00 |
| | P3[μsec] | — | — | — | 1.00 |
| NUMBER OF BLOCKS | | UNCHANGED | UNCHANGED | DECIMATED TO 1/2 | DECIMATED TO 1/3 |

P1: PRE-PULSE
P2: IDLE TIME
P3: MAIN PULSE

FIG. 17

SECOND EMBODIMENT

SIMULTANEOUS DRIVING BIT-PRINTING MODE TABLE

| NUMBER OF BITS TO BE SIMULTANEOUSLY DRIVEN | 0~2 | 3~5 | 6~8 | 9~10 |
|---|---|---|---|---|
| PRINTING MODE | NORMAL DOUBLE-PULSE MODE | NORMAL SINGLE-PULSE MODE | DECIMATION (n=2) MODE | DECIMATION (n=3) MODE |

IMAGE PRINTING APPARATUS AND CONTROL METHOD THEREFOR

This application is a division of Application No. 10/150,917 filed May 22, 2002 now U.S. Pat. No. 6,648,439.

FIELD OF THE INVENTION

The present invention relates to an image printing apparatus, control method therefor, and storage medium and, more particularly, to a high-quality, high-efficiency printing method used when the printhead temperature rises in high-speed driving of an ink-jet printer for discharging ink, or when many printing elements are simultaneously driven.

BACKGROUND OF THE INVENTION

Many image printing apparatuses have recently been used, and high-speed printing, high resolution, high image quality, and low noise are demanded of these image printing apparatuses.

One image printing apparatus which meets these demands is an ink-jet printer.

The ink-jet printer discharges droplets of a printing solution (ink) from the orifices of a printhead, and adheres the droplets to a printing medium to print an image. The ink-jet printer can achieve non-contact printing and obtain a stable printed image.

Most of ink-jet printers employ a driving method of discharging ink from a plurality of nozzles within a short time in order to print a line in the direction of an ink discharge nozzle line as linear as possible.

However, in this driving method, the number of nozzles to be simultaneously driven increases as the number of nozzles is increased to print a high-resolution image at a high speed. This causes the voltage drop of a nozzle driving power supply voltage, or temporarily increases the negative pressure level in a liquid chamber common to ink tanks, failing to refill the chamber with ink.

To prevent this, nozzles are grouped into several blocks, and the blocks are driven with a delay (by time division), instead of simultaneously driving all the nozzles.

This time division driving method is devised in various ways.

For example, a line formed by discharge is adjusted to a straight line by such adjustment that nozzle positions and the alignment direction of a nozzle array are inclined.

As for a nozzle driving signal, a driving method using a single pulse of one rectangular wave has initially been used. However, this method cannot realize a desired discharge amount, discharge speed, refill frequency, and the like in printing an image at a high speed and high resolution. Thus, a driving method of supplying a plurality of rectangular waves for discharge of one ink droplet is being used.

For example, a thermal ink-jet method of heating a heater, and bubbling and discharging ink generally adopts a double-pulse driving method using two rectangular waves, as shown in FIG. 5.

In the double-pulse driving method, ink on the heater is preheated by a first pulse P1 as a pre-pulse. After an idle time P2, ink is heated, bubbled, and discharged by a second pulse P3 as a main pulse. The ink discharge efficiency is higher, compared to a single pulse using only the second pulse P3 as a main pulse.

The double pulses can control the ink discharge amount and discharge speed by changing the period of the pre-pulse P1 and the idle time P2 of the second pulse.

A printhead used in the ink-jet printer generates bubbles in ink by using heat energy, and discharges ink on the basis of the generation of bubbles. When nozzles are repetitively used within a short time for high-speed, high-resolution image printing, heat energy generated in the printhead is not completely consumed by ink discharge, and some of the heat energy is accumulated as heat. The heat raises the temperature of the printhead, adversely affecting its printing characteristics.

For example, a rise in printhead temperature decreases the viscosity of a printing solution (ink) filled in the printhead and increases the fluidity. The printhead discharges a larger amount of ink than a predetermined discharge amount.

The ink discharge amount larger than the predetermined discharge amount adversely affects the quality of an image to be printed, and increases the ink use amount, resulting in high running cost. Further, excessively heating the printhead may damage the printhead.

To avoid this, a heat dissipation member is attached to the ink-jet printer main body or printhead, or a cooling time for cooling the printhead to a predetermined temperature is set.

To stabilize the ink discharge amount even upon a rise in printhead temperature, driving pulses are controlled in accordance with the printhead temperature, as disclosed in Japanese Patent Laid-Open No. 5-31905.

The printhead is generally operated by double-pulse driving, but when the temperature rises, driving pulses are controlled to a single pulse. This can decrease the discharge efficiency with respect to heat energy, and suppress the discharge amount. Further, as disclosed in Japanese Patent Laid-Open No. 11-170500, printing data is decimated upon a rise in temperature.

In recent years, the number of nozzles increases to several hundred or several thousand in order to meet demands for higher-speed printing and higher resolution. High-speed driving at a driving frequency of several ten kHz is required.

In the conventional driving method, the number of elements to be simultaneously driven every block by time division increases. As a result, the instantaneous maximum current increases, and the voltage drop of the power supply voltage at the intermediate wiring increases.

The number of elements to be simultaneously driven changes depending on printing data. For example, if the number of elements to be simultaneously driven increases in accordance with printing data, a power supply voltage necessary to discharge ink is not applied to the heater, failing to discharge ink.

As a method of solving this problem, the wiring resistance is minimized, a margin for a maximum voltage drop is set, and the set voltage is increased.

However, the method of increasing the set voltage cannot cope with an increase in the number of nozzles and an increase in speed in order to realize higher-speed printing and higher resolution because the breakdown voltage of driving elements is limited.

If the number of elements to be simultaneously driven decreases in accordance with printing data, excessive energy is applied to the heater, decreasing the thermal efficiency and greatly degrading the durability of the heater for heating a driving element.

A method of solving this problem is to count the number of elements to be simultaneously driven in accordance with printing data, and to control the driving pulse and driving voltage, as disclosed in Japanese Patent Laid-Open No. 9-11504.

According to this method, elements to be simultaneously driven are counted, a power loss corresponding to a voltage drop is calculated, and the driving pulse and driving voltage are controlled to compensate for the above-mentioned nozzles which do not discharge ink. This method sets a proper driving pulse and driving voltage calculated by the number of elements to be simultaneously driven in accordance with printing data. Hence, this method is very effective in terms of the thermal efficiency of heating a driving element and the heater durability.

In the high-speed printing method of increasing the number of elements to be simultaneously driven and controlling the high-speed driving pulse, the driving pulse control width must be set large for the purpose of increasing the ink temperature to use efficient double-pulse driving or reducing an increase in voltage drop caused by the wiring resistance. Even if the conventional time division driving method is simply applied to a driving method used for a larger number of nozzles or high-speed driving, a pulse width necessary for a block time required by high-speed printing cannot be ensured.

For example, elements to be simultaneously driven in accordance with printing data are driven at 15 kHz. In addition, the elements to be simultaneously driven are grouped into 16 blocks and driven. In this case, the pulse width ensuring region for driving elements for one block must be set to 3.7 $\mu$sec or less.

However, inserting optimal double-pulse driving in the 3.7-$\mu$sec width cannot be physically achieved because of the following reason.

That is, the above-described pre-pulse P1 and idle time P2 have given time durations, which enable control operations of increasing the ink discharge amount, and when the printhead temperature rises, decreasing the printhead temperature.

From this, for a small pulse ensuring region where the control becomes impossible, the double-pulse idle time P2 is shortened though this is not an optimal control method.

Japanese Patent Laid-Open No. 7-96608 discloses a method of inserting the pre-pulse P1 into the idle time P2 of the previous block to ensure the idle time P2.

In this method, the idle time must be set to the main pulse P3 or more, and the degree of freedom for control of the discharge amount by the idle time P2 is low.

In addition, blocks are frequently switched. To perform time division by a block signal or the like, a high-speed, high-reliability logic response characteristic is required. This is disadvantageous for a large time division number.

There is also a means for decreasing the time division number. However, the time division number is difficult to change when an output from a carriage encoder is directly used as the driving division number because of an excessive voltage drop and high speed.

Japanese Patent Laid-Open No. 11-170500 discloses a control method of decimating data. This method requires a long data processing time and is disadvantageous in high-speed operation. Simply decimating data results in data loss, degrading the printing quality.

SUMMARY OF THE INVENTION

The present invention has been made to overcome the conventional drawbacks, and has as its object to provide an image printing apparatus capable of high-quality, high-efficiency printing by optimizing the number of blocks for discharging ink and the ink discharge amount in accordance with a rise in printhead temperature or the number of printing elements to be simultaneously driven even when the printhead temperature rises or high-density printing is to be performed in driving the printhead at a high speed, and a control method therefor.

To achieve the above object, a management system for an image printing apparatus according to an aspect of the present invention has the following arrangement. That is, an image printing apparatus for printing an image on the basis of input printing data by scanning a carriage for holding a printhead having a plurality of printing elements, relatively to a printing medium in a direction crossing an alignment direction of the plurality of printing elements comprises first driving means for grouping the plurality of printing elements into a plurality of blocks every predetermined number of printing elements, and driving the plurality of blocks by time division, second driving means for driving any one of the plurality of blocks by using, as a driving timing signal for performing printing once, a plurality of driving timing signals respectively used to drive the plurality of blocks by time division, and image printing means for selecting either one of the first and second driving means, and printing the image.

To achieve the above object, a method of controlling an image forming apparatus according to another aspect of the present invention has the following steps. That is, a method of controlling an image printing apparatus for printing an image on the basis of input printing data by scanning a carriage for holding a printhead having a plurality of printing elements, relatively to a printing medium in a direction perpendicular to an alignment direction of the plurality of printing elements comprises a first driving step of grouping the plurality of printing elements into a plurality of blocks every predetermined number of printing elements, and driving the plurality of blocks by time division, a second driving step of driving any one of the plurality of blocks by using, as a driving timing signal for performing printing once, a plurality of driving timing signals respectively used to drive the plurality of blocks by time division and, an image printing step of selecting either one of the first driving step and the second driving step, and printing the image.

To achieve the above object, a computer-readable storage medium according to still another aspect of the present invention has the following program codes. That is, a computer-readable storage medium which stores a control program for controlling an image printing apparatus for printing an image on the basis of input printing data by scanning a carriage for holding a printhead having a plurality of printing elements, relatively to a printing medium in a direction perpendicular to an alignment direction of the plurality of printing elements is characterized in that the control program comprises a program code of a first driving step of grouping the plurality of printing elements into a plurality of blocks every predetermined number of printing elements, and driving the plurality of blocks by time division, a program code of a second driving step of driving any one of the plurality of blocks by using, as a driving timing signal for performing printing once, a plurality of driving timing signals respectively used to drive the plurality of blocks by time division, and a program code of an image printing step of selecting either one of the first driving step and the second driving step, and printing the image.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 3 is a table showing an example of a printhead temperature—printing mode table according to the first embodiment of the present invention;

FIG. 7 is a table for explaining the contents of a printing data signal and printing block signal according to the embodiment of the present invention;

FIG. 9 is a table showing an example of a decoder output truth table for the printhead according to the embodiment of the present invention;

FIG. 12A is a table for explaining an example of a driving pulse width table for respective printing modes according to the embodiment of the present invention;

FIG. 17 is a table showing a simultaneous driving bit—printing mode table according to the second embodiment of the present invention;

DETAILED DESCRIPTION OF THE PREFERRED EMBODIMENTS

Preferred embodiments of the present invention will now be described in detail in accordance with the accompanying drawings.

In the embodiments, a color ink-jet printer in which an ink-jet printhead is mounted will be exemplified as an image printing apparatus. However, the scope of the present invention is not limited to this.

First Embodiment

[Control Arrangement of Ink-jet Printer]

Figure 10:
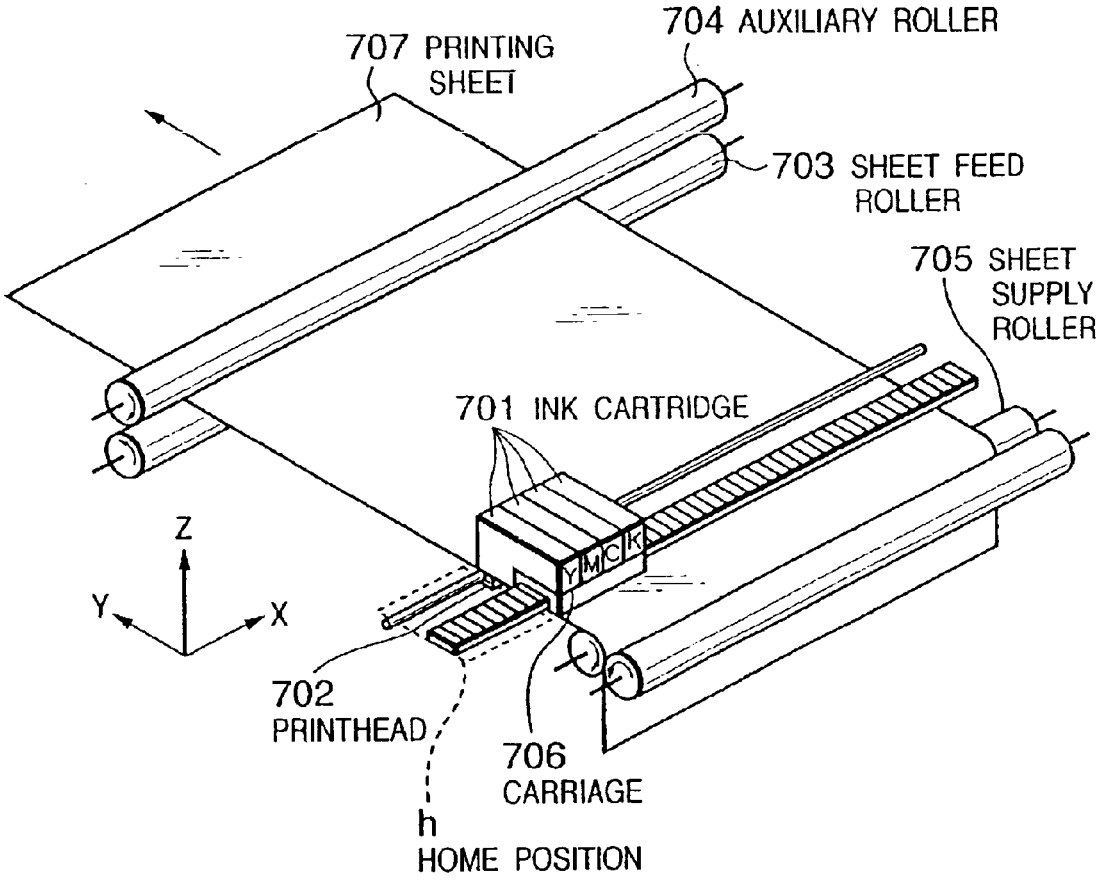
FIG. 10 is a perspective view for explaining an ink-jet printer used in the present invention.
Figure 11:
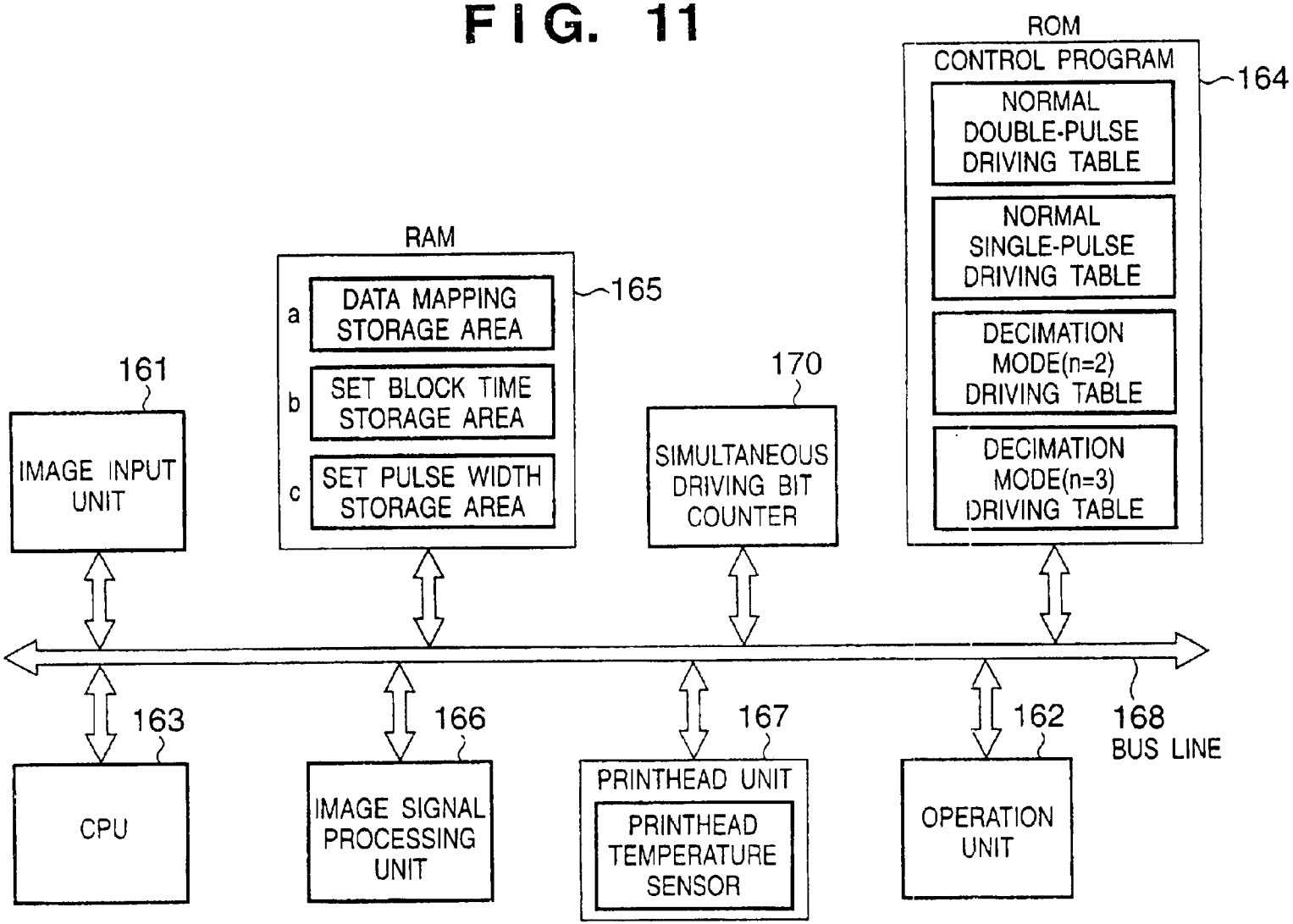
FIG. 11 is a block diagram showing the ink-jet printer according to the embodiment of the present invention.

FIG. 11 is a block diagram showing a control arrangement for executing printing control of an ink-jet printer shown in FIG. 10.

In FIG. 11, reference numeral 161 denotes an image input unit for optically reading a document image by a CCD or the like, or receiving an image brightness signal (RGB) from a host computer (not shown) or a video device or the like (not shown); and 162, an operation unit having various keys for setting various parameters or instructing the start of printing.

Reference numeral 163 denotes a CPU which controls the whole ink-jet printer in accordance with various programs in a ROM 164, and also controls ink discharge. The ROM 164 stores, e.g., programs for operating the ink-jet printer in accordance with a control program error processing program.

The ROM 164 stores a normal double-pulse driving table, normal single-pulse table, decimation mode driving table (n=2), decimation mode driving table (n=3), and the like which are used in the first embodiment. Reference numeral 165 denotes a RAM; 165*a*, a storage area for mapping printing data; 165*b*, a storage area for a set block time; and 165*c*, a storage area for storing a set pulse width.

Reference numeral 166 denotes an image signal processing unit for processing an image signal; and 167, a printhead unit for forming a dot image on the basis of the image signal processed by the image signal processing unit in printing. The printhead unit 167 includes a printhead temperature sensor for detecting the printhead temperature. Reference numeral 168 denotes a bus line for transmitting an address signal, data, a control signal, and the like in the ink-jet printer.

Reference numeral 170 denotes a simultaneous driving bit counter for counting the number of printing elements (heater elements) to be simultaneously driven which are used to print an image based on printing data.

[Schematic Structure of Ink-jet Printer]

FIG. 10 shows the schematic structure of an ink-jet printer which prints an image by using a printhead 702 having nozzle lines of four colors.

In FIG. 10, reference numeral 701 denotes an ink cartridge which is made up of the printhead 702 and ink tanks filled with four color inks, i.e., black ink, cyan ink, magenta ink, and yellow ink.

Reference numeral 703 denotes a sheet feed roller which rotates in a direction indicated by the arrow in FIG. 10 while holding a printing sheet 707 together with an auxiliary roller 704, and supplies the printing sheet 707 in the y direction (subscanning direction) at any time.

Reference numerals 705 denote sheet supply rollers which feed a printing sheet and hold the printing sheet 707, similar to the rollers 703 and 704; and, 706, a carriage which supports four ink cartridges and moves them in printing.

When no printing is done or recovery operation of the printhead 702 is to be performed, the carriage 706 stands by at a home position h indicated by the dotted line in FIG. 10.

If the carriage 706 at the home position h receives a printing start instruction before the start of printing, it prints an image on a sheet surface by a width D from n multi-nozzles arranged on the printhead 702 while moving in the x direction (main scanning direction).

This printing is executed at the reading timing of an encoder, and printing elements (heat elements) are driven based on a printing signal. Ink droplets are discharged and fixed onto a printing medium in an order of black ink, cyan ink, magenta ink, and yellow ink, thereby forming an image.

After data is printed up to the end of the sheet surface, the carriage 706 returns to the home position, and prints an image in the x direction (forward scanning direction) again. For reciprocate printing, the carriage 706 prints an image while moving in the −x direction (backward scanning direction).

During the interval between the end of the first printing and the start of the second printing, the sheet feed roller 703 rotates in the direction indicated by the arrow to feed the sheet by the width D in the y direction. By repetitively feeding the sheet by the multihead width D in the y direction every scan of the carriage, printing of data on one sheet surface is completed.

[Ink Cartridge]

Figure 13:
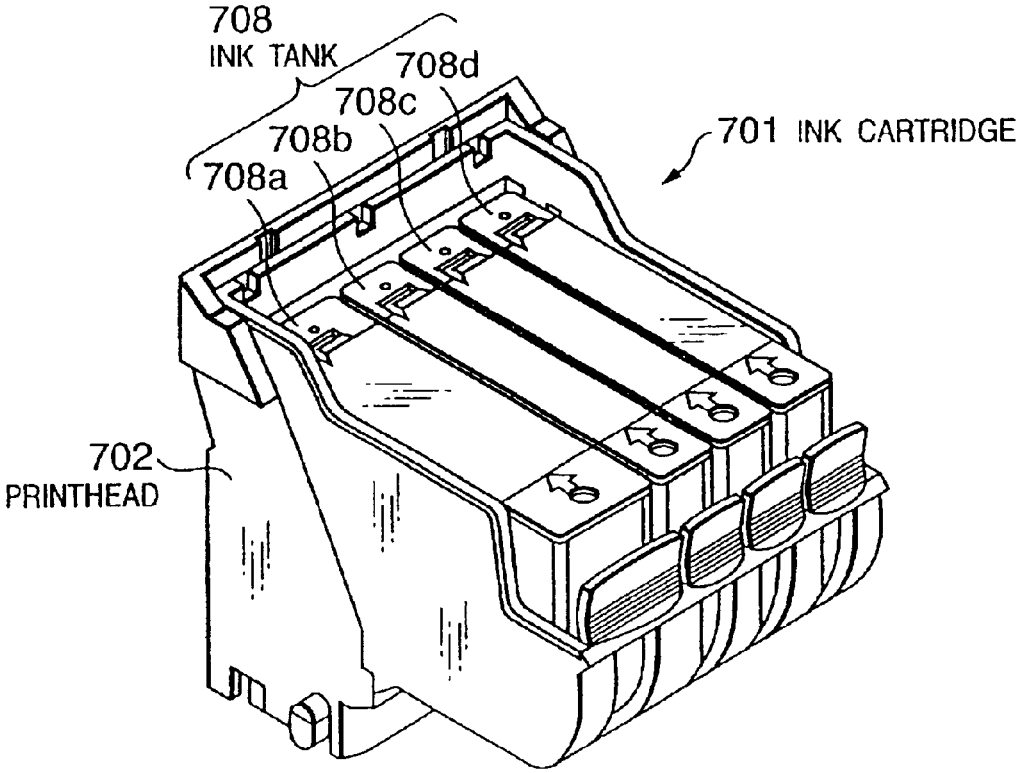
FIG. 13 is a perspective view for explaining an example of an ink head cartridge according to the embodiment of the present invention.
Figure 14:
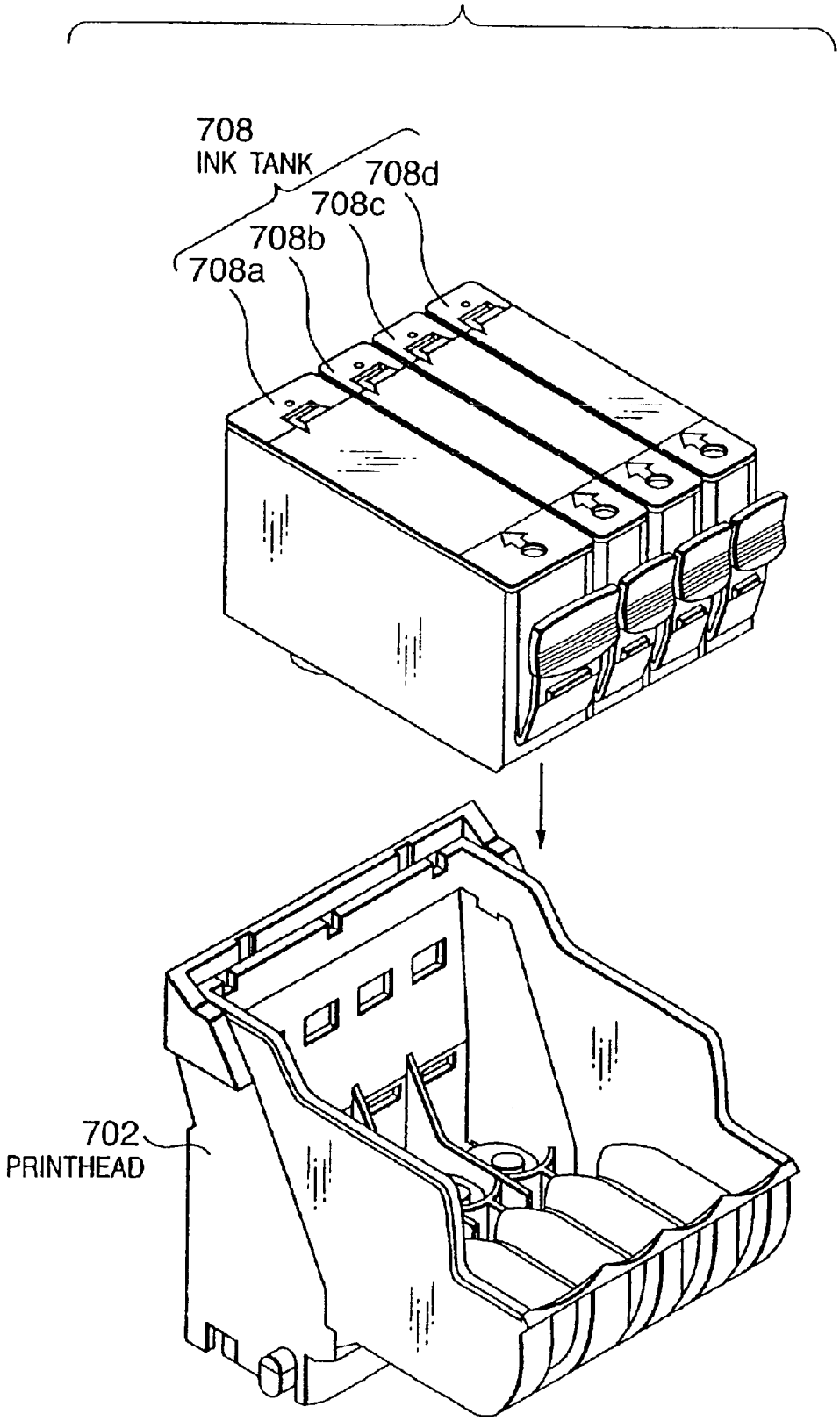
FIG. 14 is a perspective view for explaining the relationship between the ink head cartridge, the printhead, and the ink tank according to the embodiment of the present invention.

FIGS. 13 and 14 are views for explaining the relationship between the ink cartridge 701, the printhead 702, and ink tanks 708. The respective building components will be explained with reference to FIGS. 13 and 14.

The printhead 702 is one of building components which constitute the ink cartridge 701. The ink cartridge 701 is made up of the printhead 702, and ink tanks 708 (708*a*, 708*b*, 708*c*, and 708*d*) detachably mounted on the printhead 702.

The ink cartridge 701 is fixed and supported by the positioning means and electrical contact of the carriage 706 mounted on the ink-jet printer main body. The ink cartridge 701 is detachable from the carriage 706.

The ink tank 708*a* is an ink tank for black ink; the ink tank 708*b*, an ink tank for cyan ink; the ink tank 708*c*, an ink tank for magenta ink; and the ink tank 708*d*, an ink tank for yellow ink. The ink tanks 708*a*, 708*b*, 708*c*, and 708*d* are freely detachable from the printhead 702, which reduces the running cost of printing in the ink-jet printer.

[Electrical Arrangement of Printhead]

The electrical arrangement of the printhead 702 mounted on the ink-jet printer according to the first embodiment will be explained.

Figure 4:
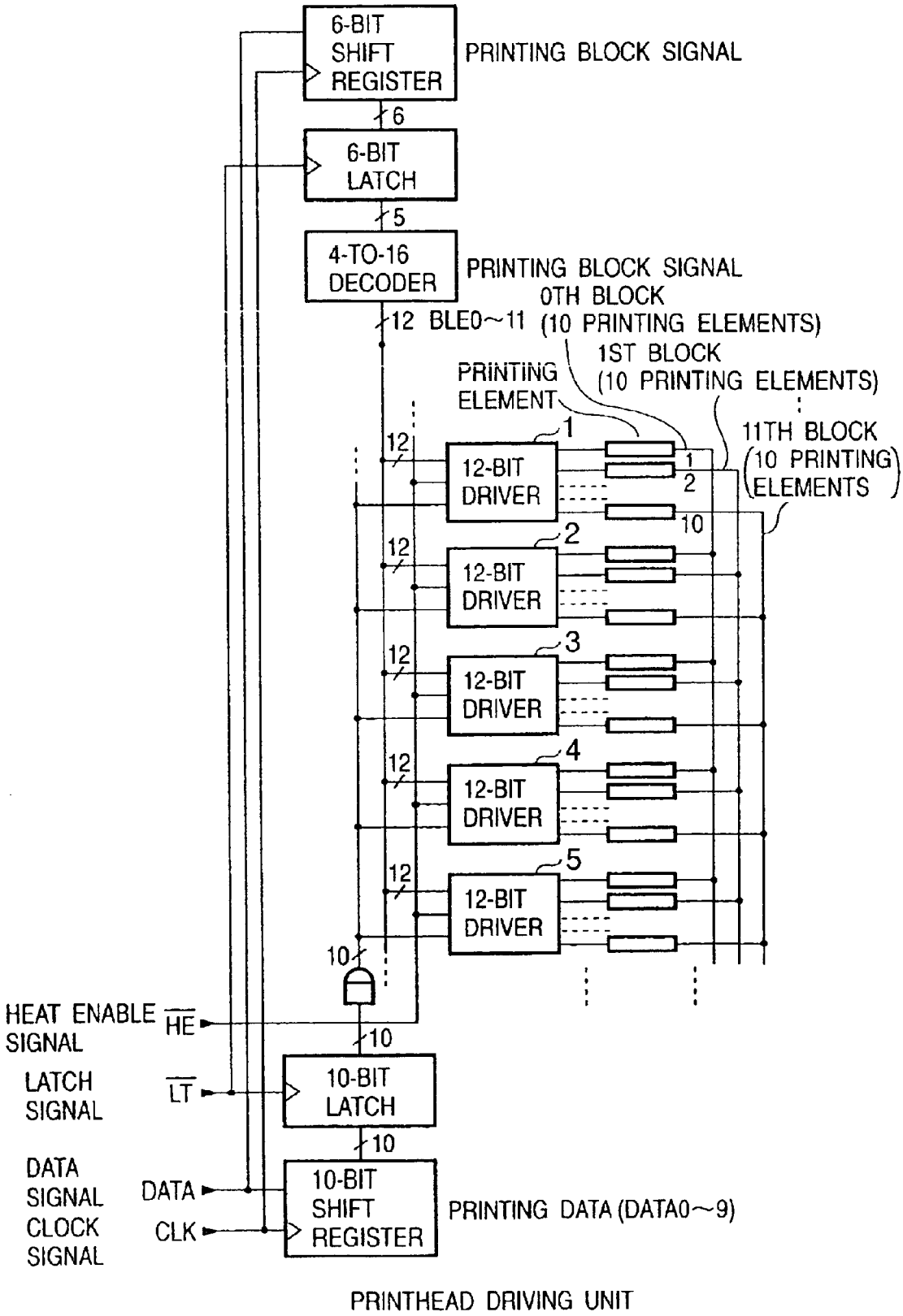
FIG. 4 is a circuit diagram showing driving control of the printhead according to the embodiment of the present invention.
Figure 5:
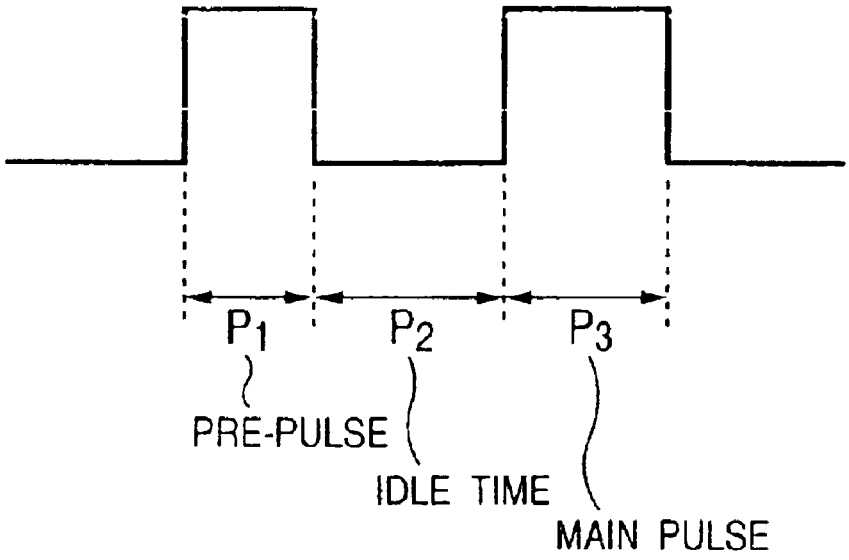
FIG. 5 is a schematic view showing double pulses in a conventional printhead.

FIG. 4 is a circuit diagram for explaining the electrical arrangement of the printhead 702. As shown in FIG. 4, the printhead 702 has 120 printing elements (heater elements). The 0th to 11th blocks contain 10 printing elements each. The printing elements grouped into 12 (blocks) are sequentially driven from the 0th block to the 11th block (time-divisional driving).

[Printing Bit and Data Transfer of Printing Block]

The operation will be described in accordance with the timing charts shown in FIGS. 6 and 8.

Figure 6:
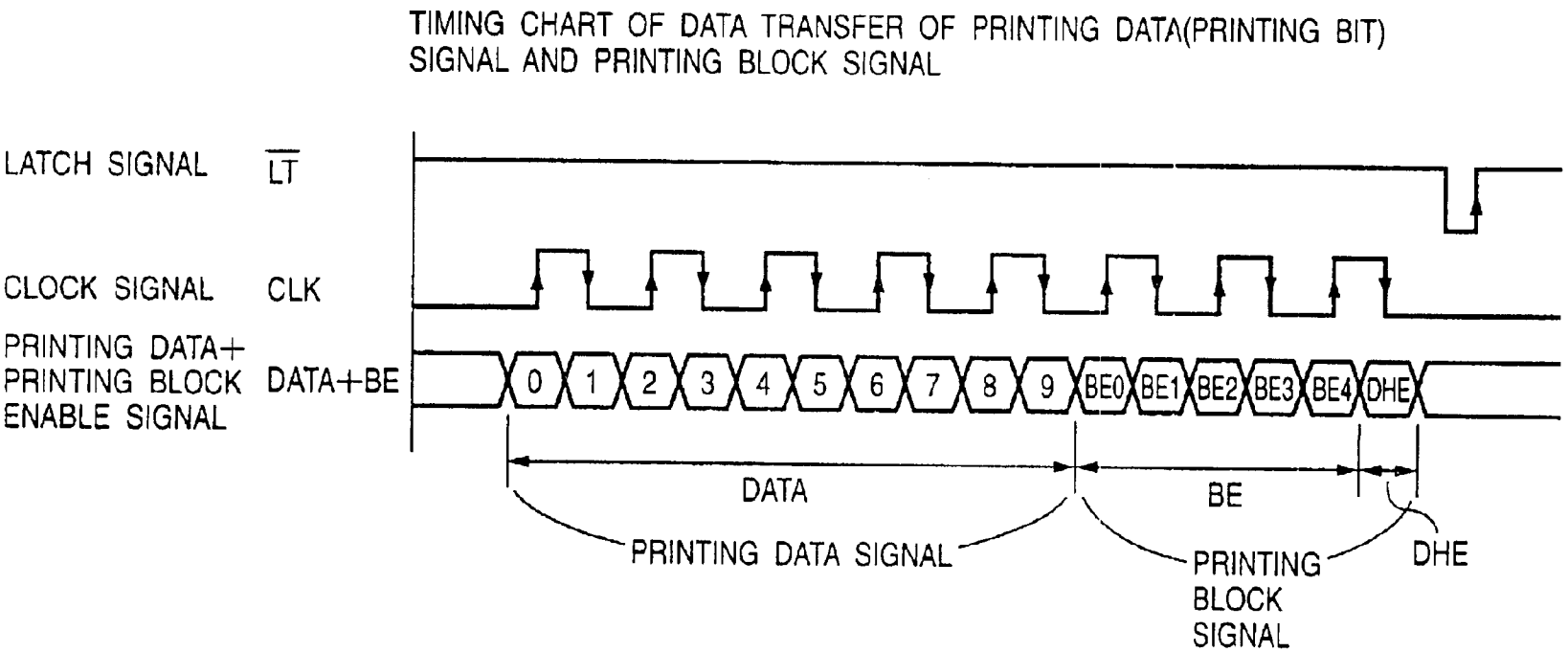
FIG. 6 is a timing chart showing data transfer of a printing bit and printing block according to the embodiment of the present invention.

FIG. 6 is a timing chart showing data transfer of printing data (printing bit) signals and printing block signals in one block.

A DATA+BE signal (FIG. 6) sent from a DATA terminal in FIG. 4 is output in accordance with the edge timing of a CLK signal (FIG. 6) sent from a CLK terminal in FIG. 4.

The DATA+BE signal represents printing data signals and printing block signals. As shown in FIG. 7, input order numbers 1 to 10 represent printing data (printing bit) signals, i.e., heater-on/heater-off states, and are sequentially stored in a 10-bit shift register (6-bit S/R) in FIG. 4. Input order numbers 11 to 16 represent printing block signals, i.e., heater driving blocks, and are sequentially stored in a 6-bit shift register in FIG. 4.

In FIG. 6, after data transfer of printing data (printing bit) signals and printing block signals for one block ends, data in the 10-bit register and 6-bit register in FIG. 4 are respectively latched by a 10-bit latch (10-bit LATCH) and 6-bit latch (bit LATCH) in accordance with the leading edge of an LT signal (FIG. 8) output from an LT terminal in FIG. 4.

[Data Transfer of Printing Bit and Printing Block, and Driving of Printing Element]

Figure 8:
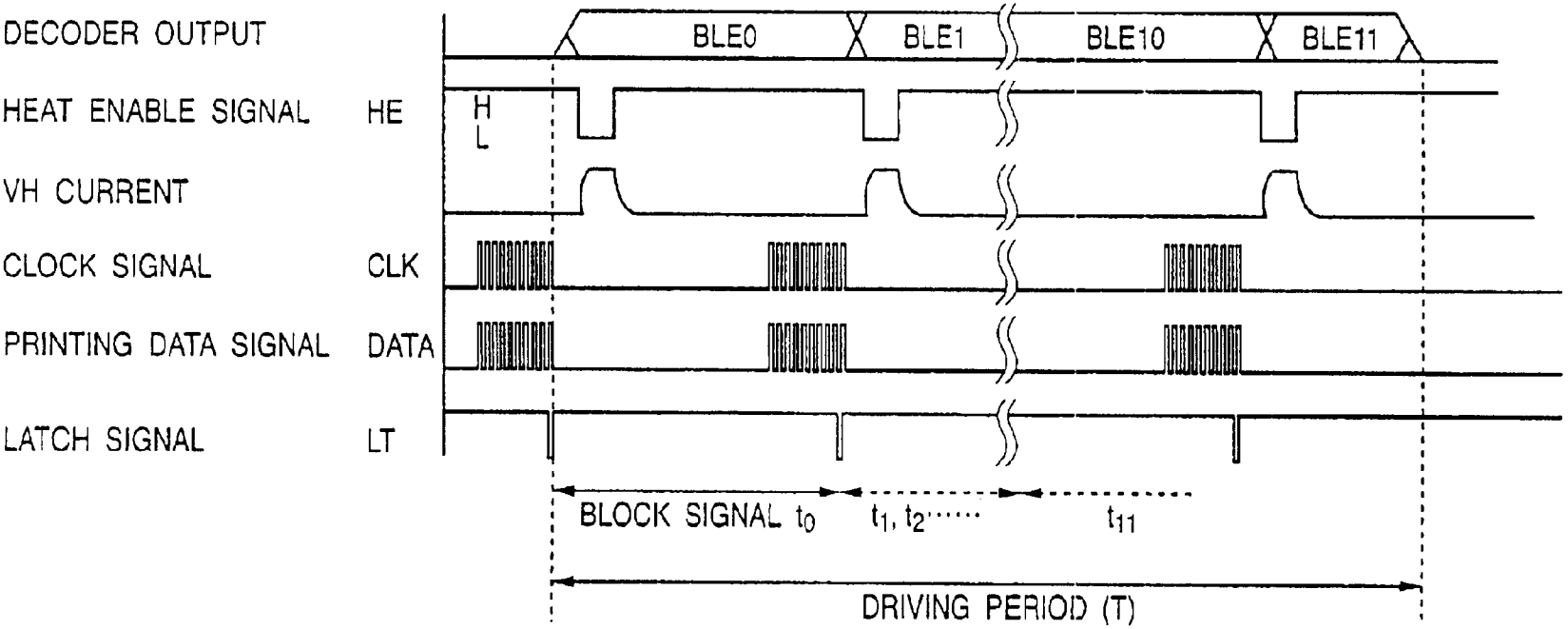
FIG. 8 is a timing chart showing an example of driving of the printing bit, printing block, and printing element according to the embodiment of the present invention.

FIG. 8 is a timing chart showing data transfer of the printing bit and printing block in one raster, and driving of the printing element.

After data of one block are transferred, transfer of data and driving of the printing element are simultaneously performed from the next block. Block data latched by the 6-bit latch in accordance with the LT signal are decoded by a decoder in FIG. 4 into 16 decoded outputs (BLE0 to BLE15) shown in FIG. 9.

Of these decoded outputs, 12 decoded outputs (BLE0 to BLE11) shown in FIG. 4 are connected to 10 12-bit drivers for printing elements.

Then, an HE signal is input from an HE terminal in FIG. 4. The HE signal is an active-low signal. The HE terminal is connected to all the 12-bit drivers for printing elements.

Ten printing data latched by the 10-bit latch are connected to the heaters of 12 blocks to selectively drive 120 (bit) printing elements by a matrix of printing data and block data.

The HE signal sets a driving pulse width for driving printing elements. That is, the BE signal, DATA signal, and HE signals are connected to an AND circuit (not shown) by drivers. When all the signals are enabled, a VH current shown in FIG. 8 flows through printing elements.

As shown in FIG. 8, block data BLE11 is sent from BLE0, and printing elements belonging to respective blocks are sequentially driven in accordance with printing data. As a result, 120 (bit) printing elements (heater elements) in one raster are selectively driven.

Respective block times are determined by the timings of latch signals, and will be referred to as t0 to t11. The total block time from BLE0 to BLE11 will be referred to as a driving period T. The driving period T can be calculated from the respective block times. The driving period T is managed by the CPU 163, and changed by changing the period of the latch signal as needed under the control of the CPU 163.

The above arrangement of printing elements is adopted for each ink color.

[Image Printing Control Method]

An image printing control method executed under the control of the CPU 163 will be explained with reference to FIGS. 1A, 1B, 1C, 1D, 2A, 2B, 2C, 3, 11, 12A, 12B, 15, and 16.

FIGS. 1A, 1B, 1C, and 1D are timing charts of image printing. FIGS. 2A, 2B, and 2C are views showing the size and line of discharge dots when an image is printed as shown in FIGS. 1A, 1B, 1C, and 1D.

FIG. 3 shows a printhead—printing mode table in the first embodiment. FIG. 11 is a block diagram showing the arrangement of the ink-jet printer, and FIG. 12A shows an example of a driving pulse width table in each printing mode that is stored in the ROM 164 of FIG. 11.

Figure 12B:
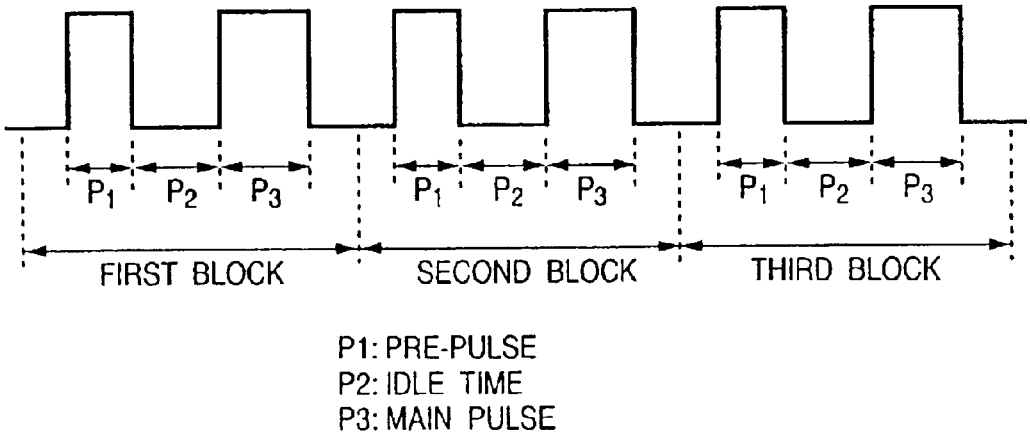
FIG. 12B is a waveform chart for explaining a driving pulse waveform according to the embodiment of the present invention.

FIG. 11 is a block diagram showing a control arrangement for executing printing control of the ink-jet printer. FIG. 12A shows an example of the driving pulse width table in each printing mode that is stored in the ROM 164 of FIG. 11. FIG. 12B is a timing chart for explaining first, second, and third block pulses P1, P2, and P3 in the driving pulse width table of FIG. 12A.

Figure 15:
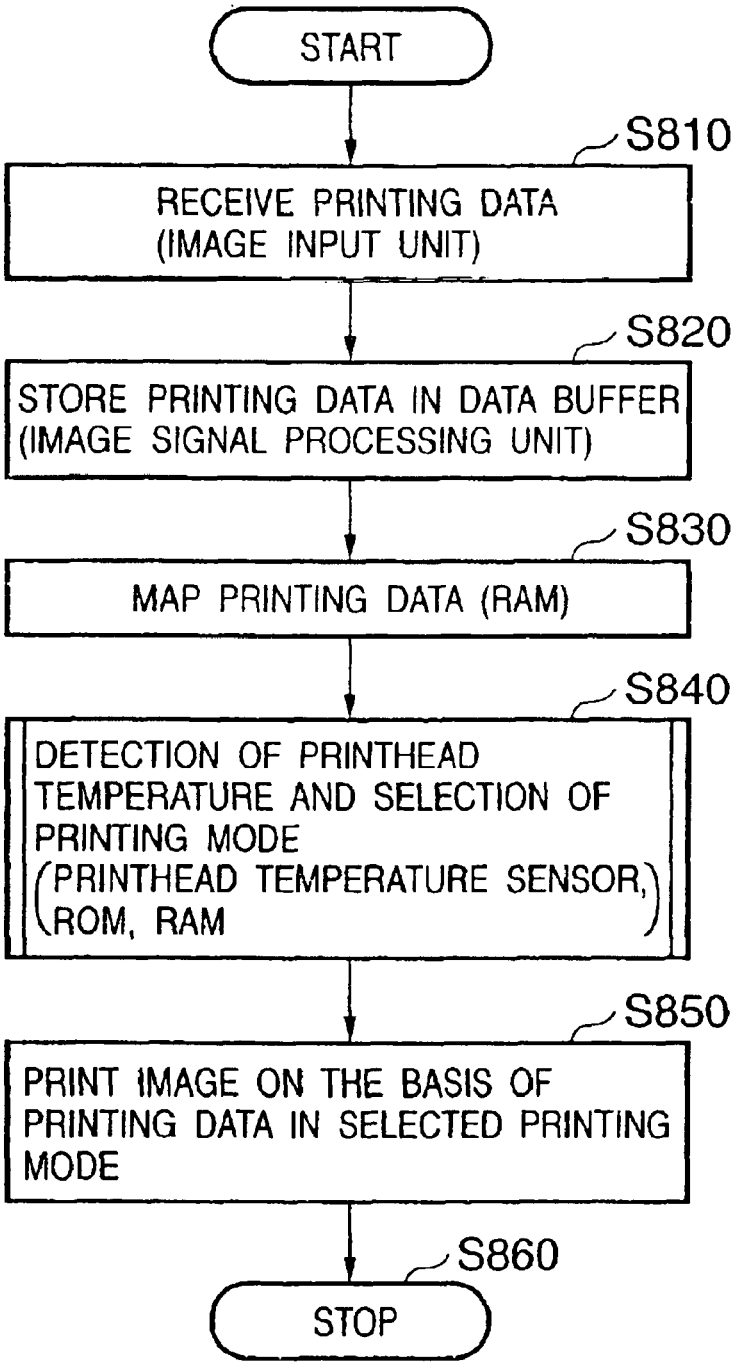
FIG. 15 is a flow chart for explaining an image printing control method according to the first embodiment of the present invention.
Figure 16:
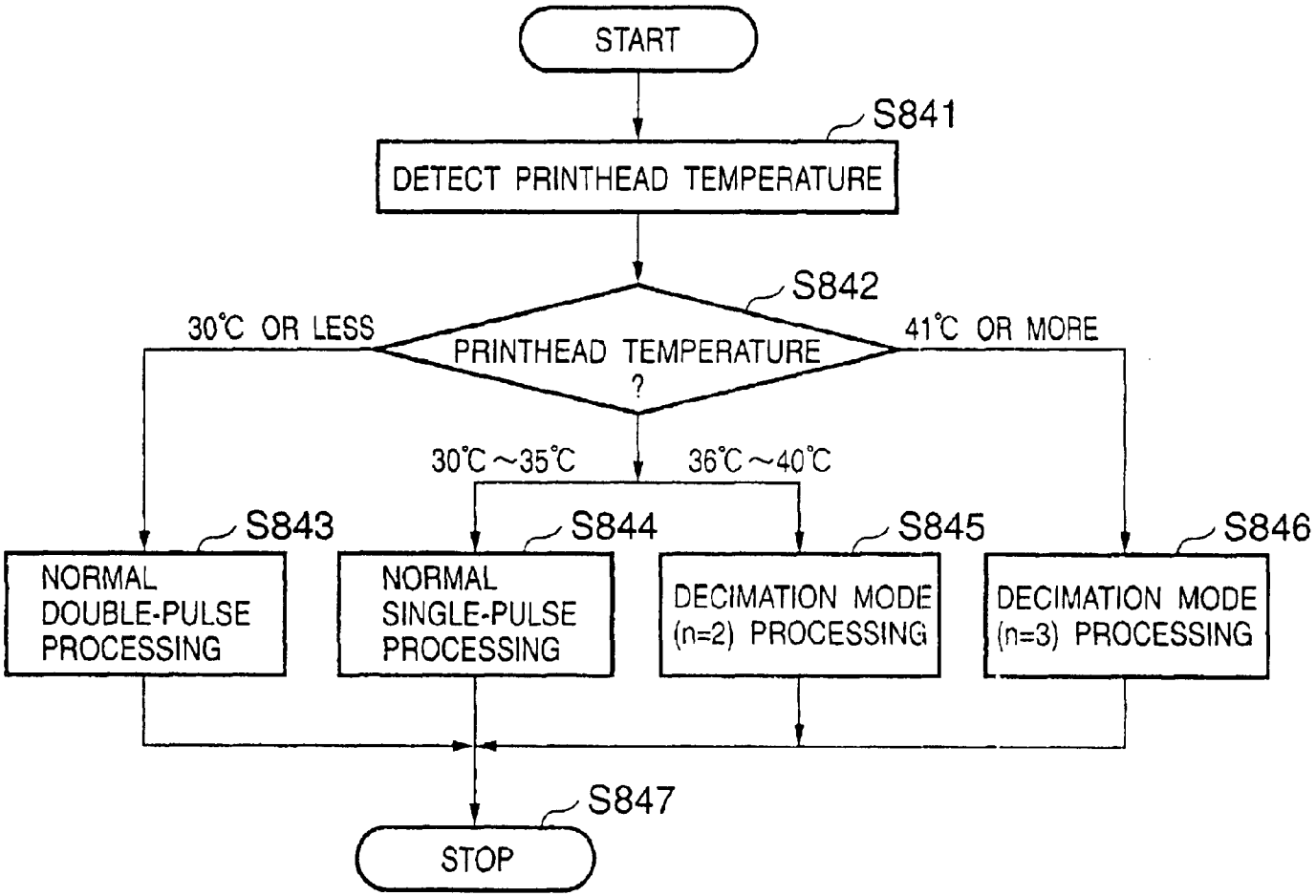
FIG. 16 is a flow chart for explaining a printing mode selection method according to the first embodiment of the present invention.

FIGS. 15 and 16 are flow charts for explaining the image printing control method.

In the following description, image printing using an ink tank of one color will be explained for descriptive convenience.

The image printing control method in the first embodiment will be described with reference to FIGS. 15 and 16.

The image input unit 161 in a standby state receives a printing data signal in step S810, and then the flow shifts to step S820. The image signal processing unit 166 stores the printing data signal in a data buffer.

In step S830, the printing data signal temporarily stored in the image signal processing unit 166 is mapped in the data mapping area 165*a* of the RAM 165.

In step S840, the printhead temperature sensor in the printhead unit 167 detects a printhead temperature. A printing mode corresponding to the detected printhead temperature is selected.

Processing in step S840 will be described in detail with reference to FIG. 16. More specifically, the printhead temperature is detected in step S841 of FIG. 16, and then the flow advances to step S842 to select a printing mode corresponding to the detected printhead temperature.

If the detected printhead temperature is 30° C. or less in step S842, the flow shifts to step S843 to select normal double-pulse processing. A pulse width for driving each block is set by referring to the normal double driving table of the ROM 164 that corresponds to the selected printing mode. The set pulse width is written in the set pulse width area 165*c*.

If the detected printhead temperature is 30° C. to 35° C. in step S842, the flow shifts to step S844 to select normal single-pulse processing. A pulse width for driving each block is set by referring to the normal single-pulse driving table of the ROM 164 that corresponds to the selected printing mode. The set pulse width is written in the set pulse width area 165*c*.

If the detected printhead temperature is 36° C. to 40° C. in step S842, the flow shifts to step S845 to select decimation mode (n=2) processing. A pulse width for driving each block is set by referring to the decimation mode (n=2) driving table of the ROM 164 that corresponds to the selected printing mode. The set pulse width is written in the set pulse width area 165*c*.

If the detected printhead temperature is 41° C. or more in step S842, the flow shifts to step S846 to select decimation mode (n=3) processing. A pulse width for driving each block is set by referring to the decimation mode (n=3) driving table of the ROM 164 that corresponds to the selected printing mode. The set pulse width is written in the set pulse width area 165*c*.

In step S850 of FIG. 15, the printhead unit 167 prints an image on the basis of printing data in the selected printing mode. The flow advances to step S860 to end a series of operations.

[Printing Mode and Driving Pulse]

The four driving modes described above (normal double-pulse processing, normal single-pulse processing, decimation mode (n=2) processing, and decimation mode (n=3) processing), and the driving pulse will be explained in detail with reference to FIGS. 1A, 1B, 1C, 1D, 2A, 2B, and 2C.

[Normal Double-pulse Processing]

Figure 1A:
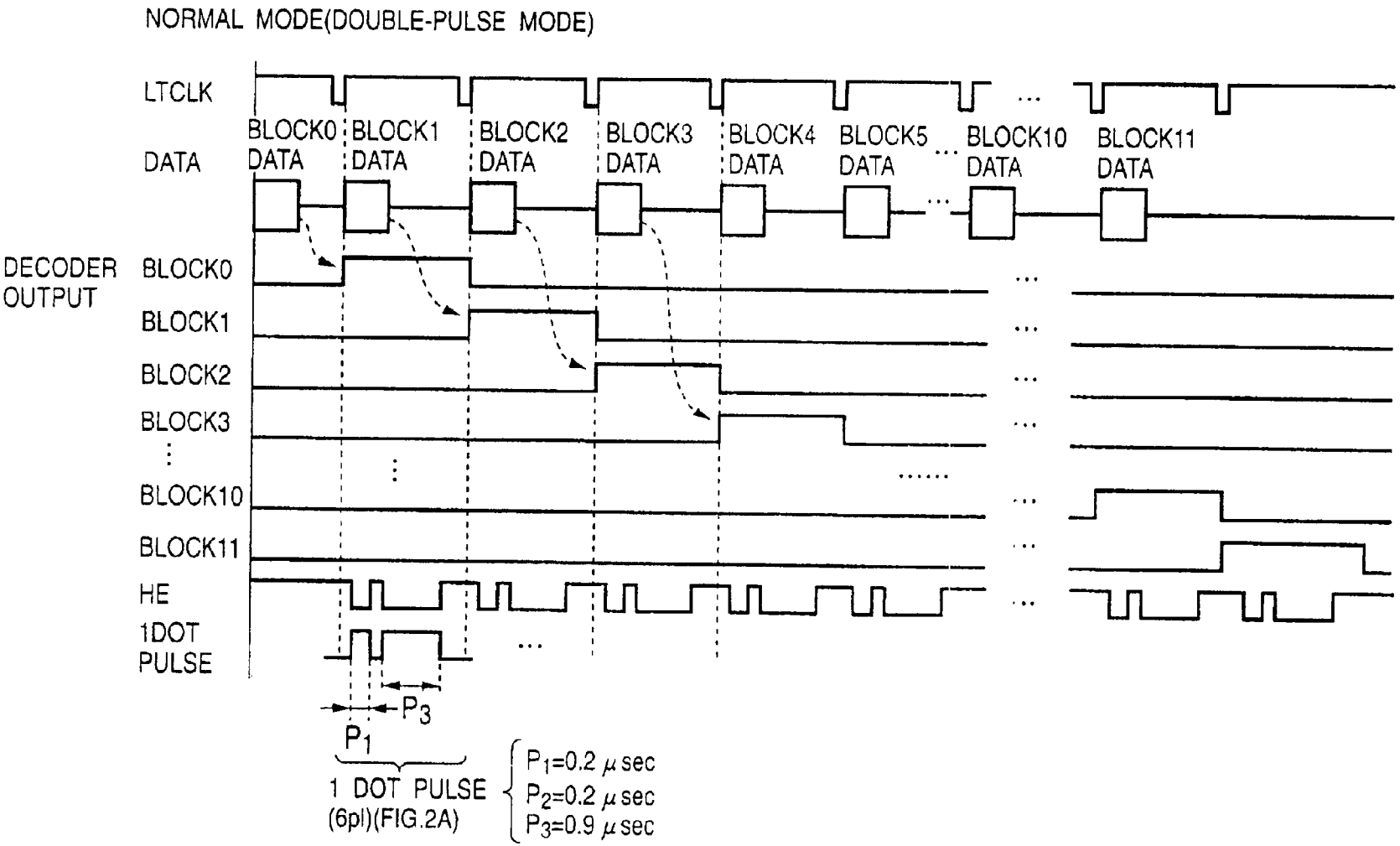
FIG. 1A is a timing chart showing an example of driving control (normal double-pulse mode) of a printhead according to an embodiment of the present invention.
Figure 2A:
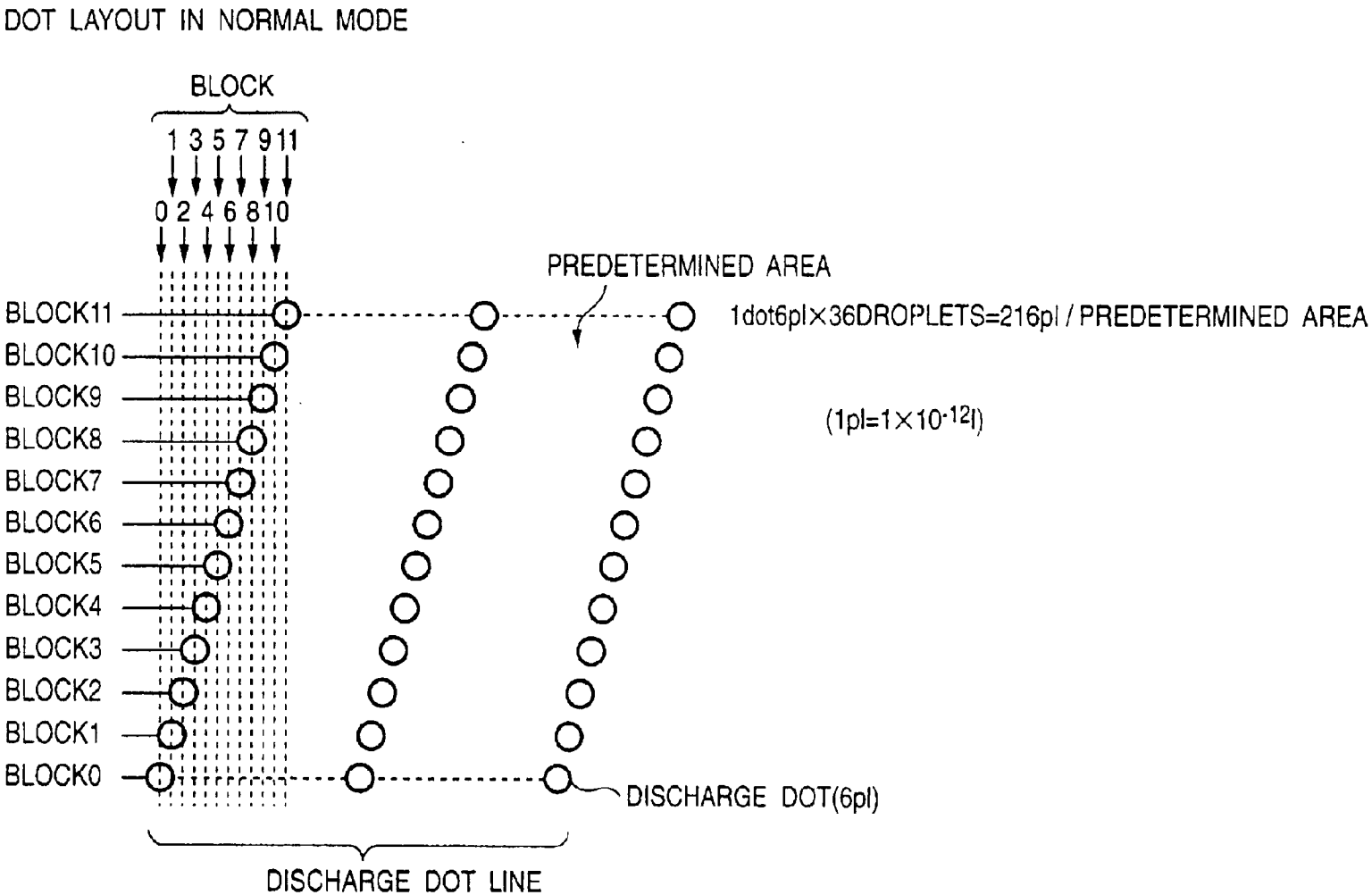
FIG. 2A is a schematic view showing an example of a dot landing position in the normal mode according to the embodiment of the present invention.
Figure 2B:
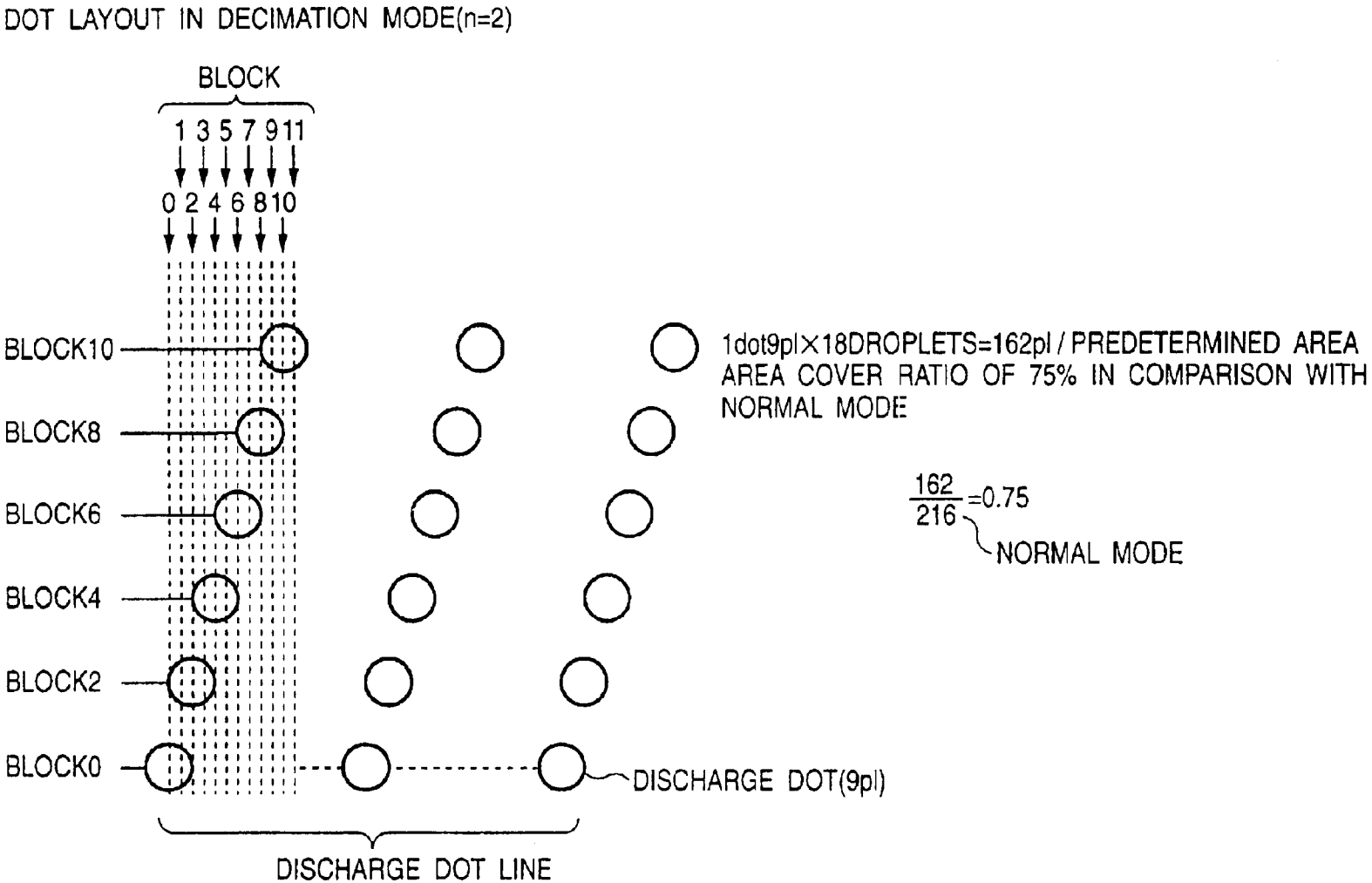
FIG. 2B is a schematic view showing an example of the dot landing position in the decimation mode (n=2) according to the embodiment of the present invention.
Figure 2C:
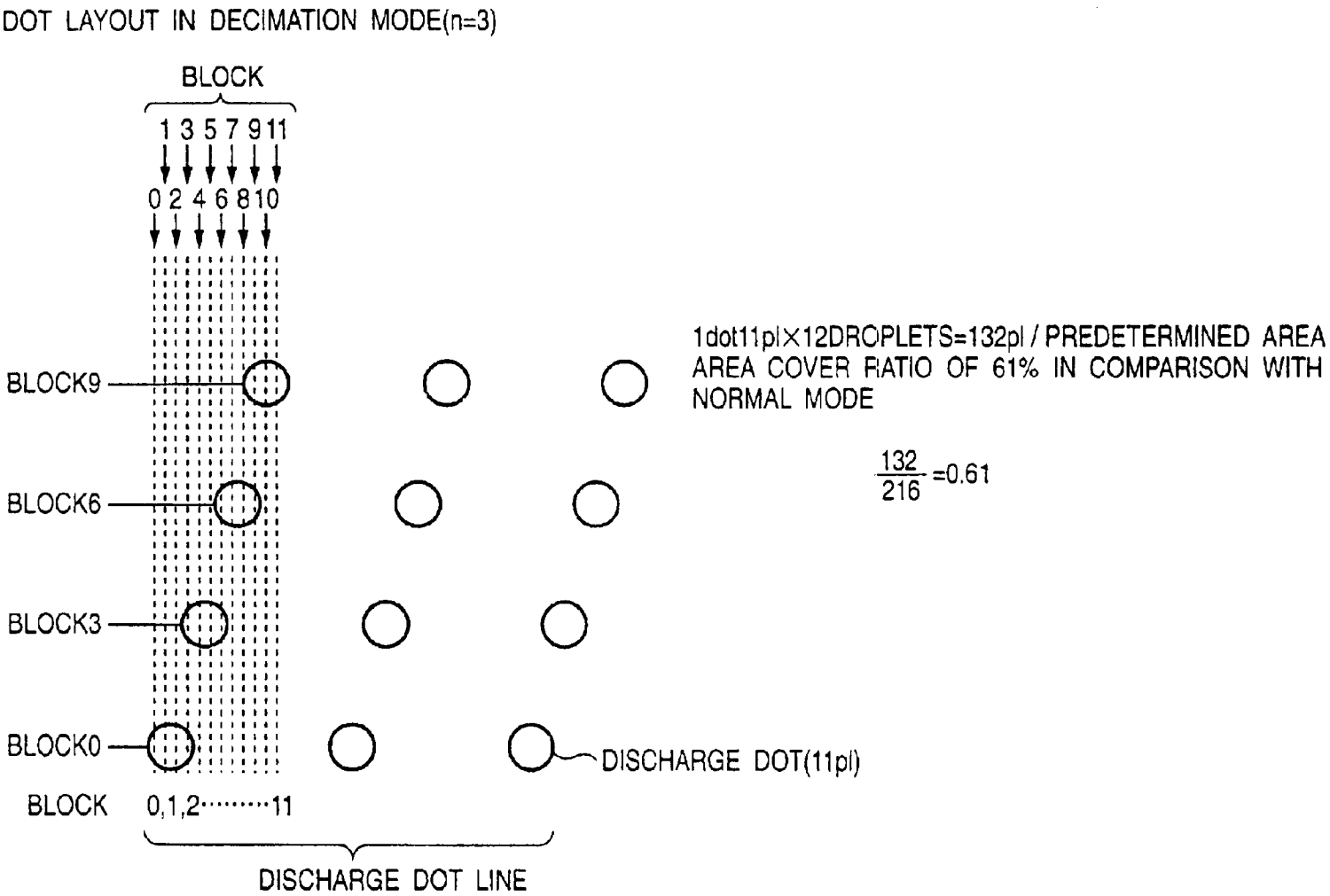
FIG. 2C is a schematic view showing an example of the dot landing position in the decimation mode (n=3) according to the embodiment of the present invention.

Normal double-pulse processing in FIG. 1A is a printing mode used when the printhead temperature is room temperature of 30° C. or less. In this mode, the printhead does not increase in temperature, is sufficiently cooled, and can perform printing using normal double-pulse driving without changing the number of blocks.

As shown in an example of FIG. 12A, the pulse widths P1, P2, and P3 in normal double-pulse processing are 0.2 μsec, 0.2 μsec, and 0.7 μsec, respectively. The idle time P2 is set to a small value enough to fall within this block.

FIG. 2A shows a discharge dot line in the use of normal double-pulse processing. In normal double-pulse processing, the printing elements of all the 12 blocks 0 to 11 are used, as shown in FIG. 2A.

An ink discharge amount when an image area (predetermined area) shown in FIG. 2A is to be printed using normal double-pulse driving is calculated. The ink discharge amount (one droplet) from each nozzle shown in FIG. 2A is about 6 pl. The ink discharge amount (36 droplets), i.e., landing ink amount in an image area (predetermined area) printed using 36 droplets discharged from blocks 0 to 11, is 6 pl×36 droplets=216 pl/predetermined area.

[Normal Single-pulse Processing]

Figure 1B:
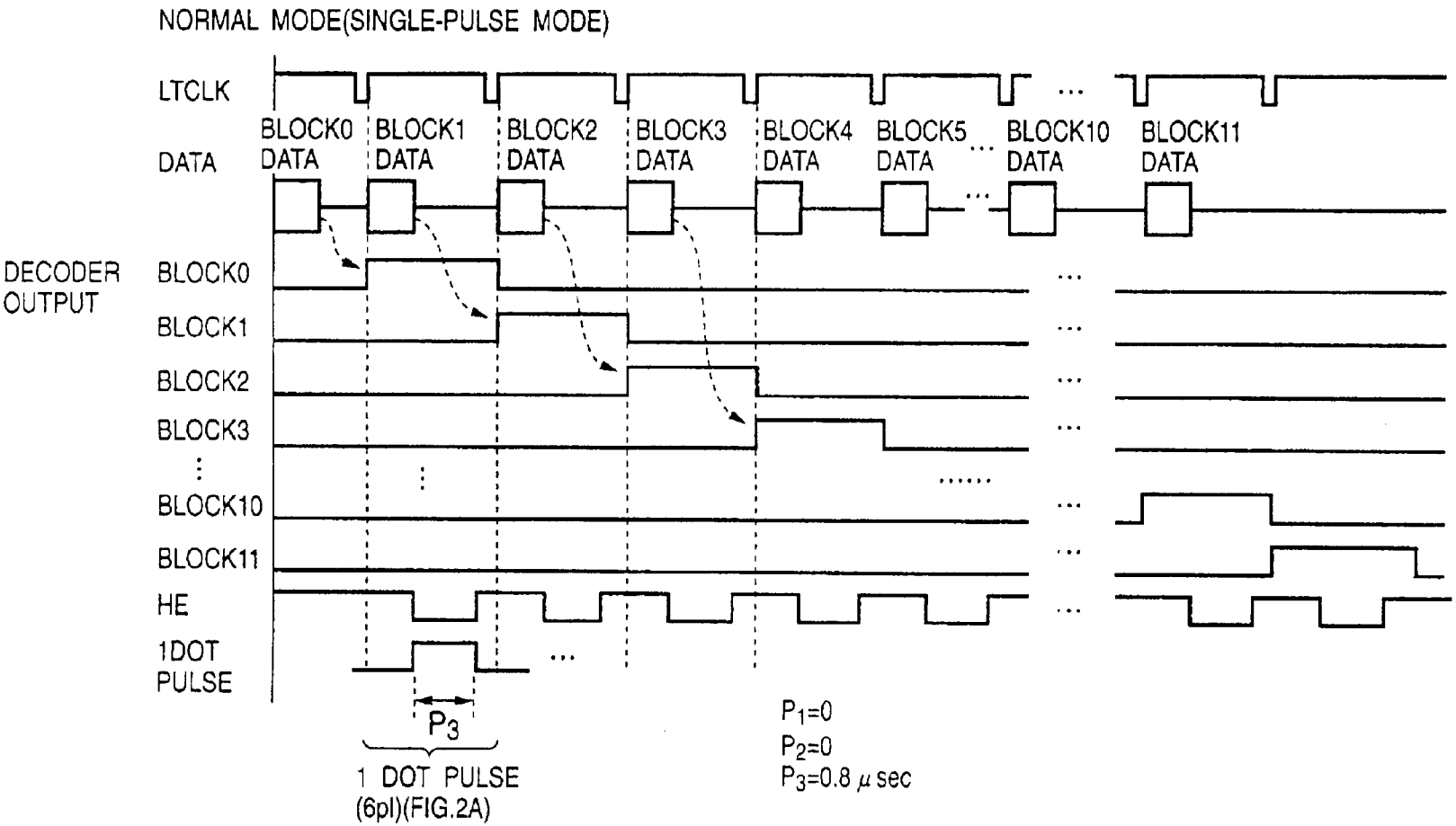
FIG. 1B is a timing chart showing an example of driving control (normal single-pulse mode) of the printhead according to the embodiment of the present invention.

Normal single-pulse processing in FIG. 1B is a printing mode used when the printhead temperature is 30° C. to 35° C.

The printhead in normal single-pulse processing of FIG. 1B slightly increases in temperature. Since a pre-pulse in normal double-pulse processing shown in FIG. 12A need not be used, only a single pulse without any pre-pulse P1 is used.

Hence, normal single-pulse processing is a mode capable of performing printing without changing the number of blocks, similar to normal double-pulse processing.

As shown in an example of FIG. 12A, the pulse widths P1, P2, and P3 in normal single-pulse processing are 0.0, 0.0, and 0.8 μsec, respectively. Compared to the bubbling energy (P1+P3=0.9 μsec) of normal double pulses, the bubbling energy (P3=0.8 μsec) is suppressed.

In normal single processing, the ink viscosity is low because the printhead is satisfactorily preheated to 30° C. to 35° C. Even by omitting any pre-pulse to suppress the bubbling energy, the substantial discharge amount increases. As a result, the normal single-pulse processing can attain the same discharge amount as that in the normal double-pulse processing.

FIG. 2A shows a discharge dot line in the use of normal double-pulse processing. In normal double-pulse processing, the printing elements of all the 12 blocks 0 to 11 are used, as shown in FIG. 2A.

An ink discharge amount in printing using normal single-pulse processing is 216 pl/predetermined area, similar to normal double-pulse processing.

[Decimation (n=2) Mode Processing]

Figure 1C:
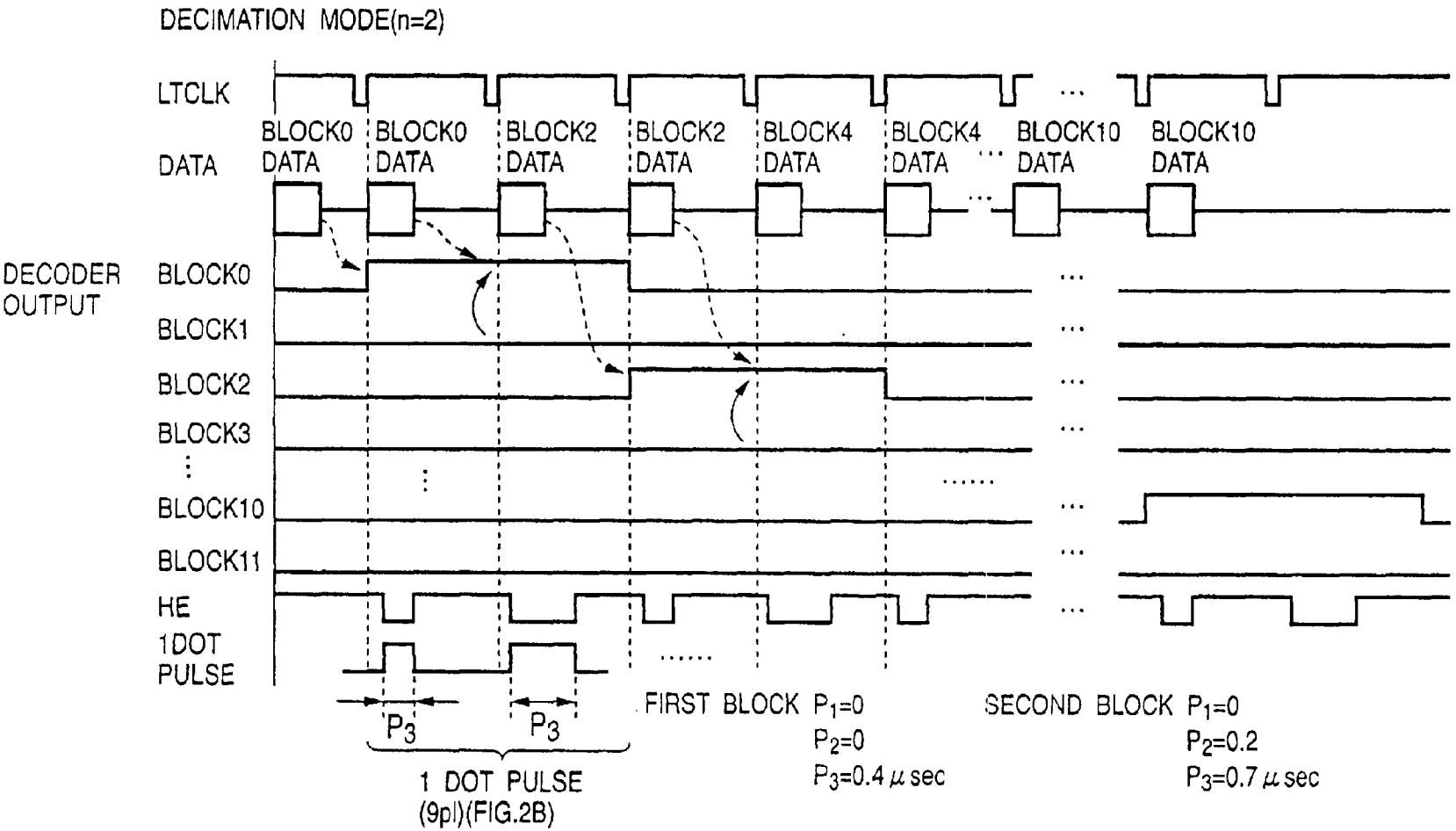
FIG. 1C is a timing chart showing an example of driving control (decimation mode (n=2)) of the printhead according to the embodiment of the present invention.

Decimation (n=2) mode processing in FIG. 1C is a printing mode used when the printhead temperature is 36° C. to 40° C.

The printhead in decimation (n=2) mode processing of FIG. 1C increases in temperature by 5° C. or more. The ink viscosity excessively decreases, and normal single-pulse processing in FIG. 12B cannot be employed.

In decimation (n=2) mode processing, the number of blocks used is decimated to ½ that of normal double-pulse processing. In decimation (n=2) mode processing, two pulse signals (P1, P2, and P3) used for instructions to the first and second blocks in FIG. 1A are combined (synthesized) into one pulse signal.

In this embodiment, the block enable signal (timing signal for block driving)of block 0,2,4, . . . is combined with the block enable signal of block 1,3,5, . . . respectively. The pulse signal width of the combined pulse signal(as shown in FIG. 1C) is twice of that of normal double-pulse signal (as shown in FIG. 1A).

More specifically, as shown in FIG. 1C, in the decimation (n=2) mode, the pulse signal (P1=0.0, P2=0.0, and P3=0.4 μsec) of the first block and the pulse signal (P1=0.0, P2=0.2 μsec, and P3=0.7 μsec) of the second block, which are successive as shown in FIG. 12A, are combined (synthesized) into one pulse signal.

This synthesized pulse signal can ensure an idle time longer than that for normal double pulses. A bubbling energy (P3+P3=0.4+0.7=1.1 μsec) larger than a normal one can be obtained.

The printhead temperature is 36° C. to 40° C., which is higher than 30° C. or less in normal double-pulse processing. The discharge amount per droplet increases to about 9 pl.

The number of blocks used is ½ that of normal double-pulse processing because only six nozzles in accordance with blocks 0, 2, 4, 6, 8, and 10 are used, as shown in FIG. 2B.

The ink discharge amount (one droplet) from each nozzle shown in FIG. 2B is about 9 pl. The ink discharge amount (18 droplets) in an image area printed using 18 nozzles of blocks 0 to 10 shown in FIG. 2B is 9 pl×18 droplets=162 pl.

This ink discharge amount (162 pl) is 162/216=0.75, i.e., 75% of the ink discharge amount (216 pl) in the same image area in normal double- or single-pulse processing of FIG. 2A or 2B.

In other words, printing the same image area (predetermined area) shown in FIG. 2A in decimation (n=2) mode processing can reduce the ink consumption used in normal double- or single-pulse processing by 25%.

As described above, an ink amount (e.g., image area shown in FIG. 2A) used to print a predetermined area is detected. A printing mode (e.g., decimation (n=2) mode processing) corresponding to the ink amount used to print the predetermined area can be selected to print an image.

In the example of the decimation (n=2) mode shown in FIG. 1C, the first one of two successive blocks is used (e.g., block 0 out of blocks 0 and 1). A block to be decimated is not limited to this, and the second one of two successive blocks (e.g., block 1 out of blocks 0 and 1) may be used.

A conventional control method prints an image by using normal double-pulse processing or the like even when the printhead temperature greatly rises to 36° C. to 40° C. (e.g., when high-density image printing is to be performed). The ink discharge amount increases, and ink overflows from printed pixels, or ink blur or inter-color blur (bleed) occurs. As a result, the image quality degrades, which cannot be prevented by the conventional control method. The use of decimation (n=2) mode processing described above can solve the problem of the conventional control method. Even if the ink consumption is suppressed, printing degradation hardly occurs, and the printing quality can be greatly improved.

[Decimation (n=3) Mode Processing]

Figure 1D:
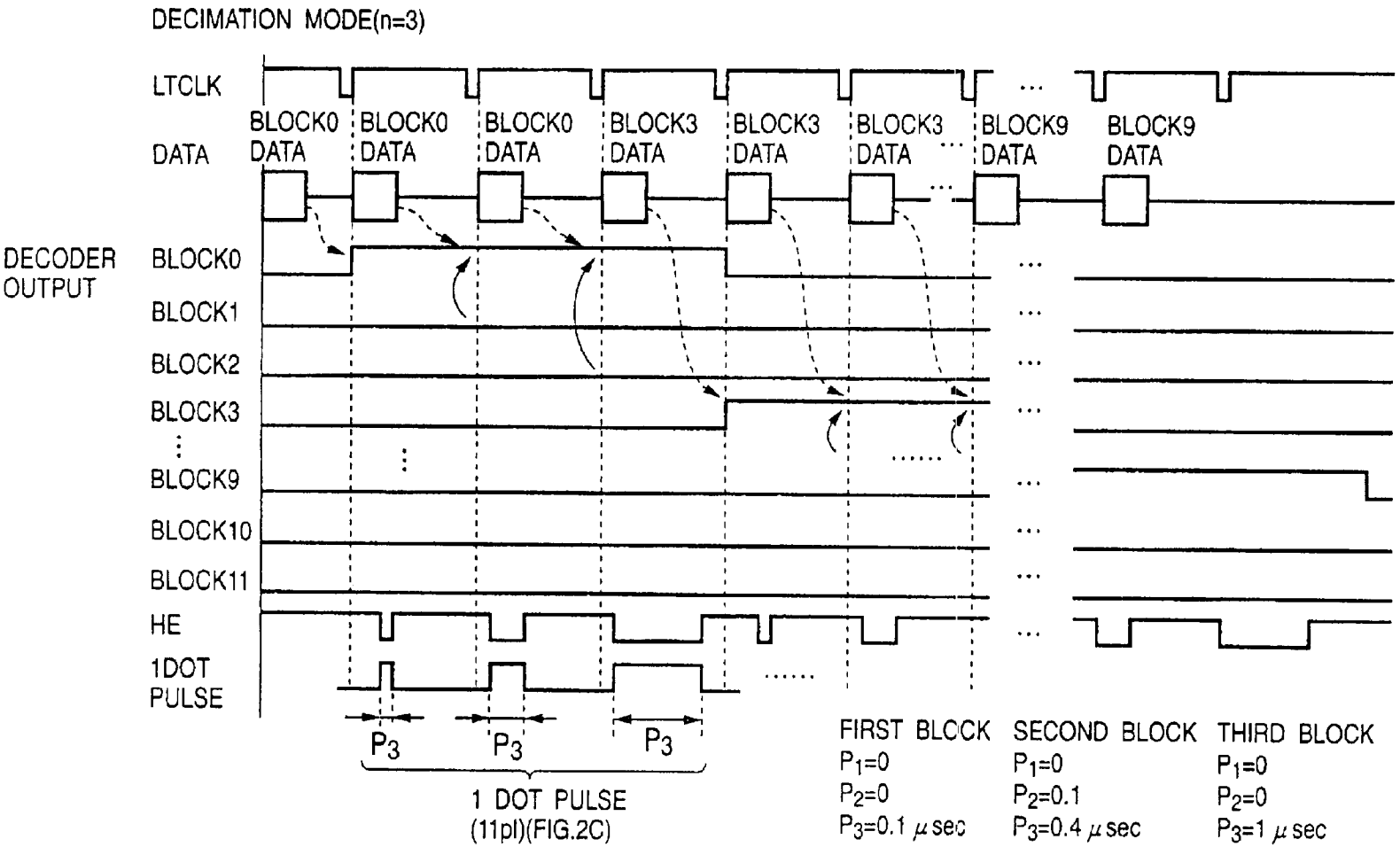
FIG. 1D is a timing chart showing an example of driving control (decimation mode (n=3)) of the printhead according to the embodiment of the present invention.

Decimation (n=3) mode processing in FIG. 1D is a printing mode used when the printhead temperature is 40° C. or more.

The printhead in decimation (n=3) mode processing of FIG. 1D increases in temperature by 10° C. or more. The ink viscosity decreases more than that in FIG. 1C, and decimation (n=2) mode processing in FIG. 1C cannot be adopted.

In decimation (n=3) mode processing, the number of blocks used is decimated to ⅓ that of normal double-pulse processing. In decimation (n=3) mode processing, three pulse signals (P1, P2, and P3) used for instructions to the first to third blocks in FIG. 1A are combined (synthesized) into one pulse signal.

In this embodiment, the block enable signal (timing signal for block driving) of block 0 is combined with the block enable signal of block 1 and 2, and the block enable signal of block 3 is combined with the block enable signal of block 4, and 5, . . . , respectively. The pulse signal width of the combined pulse signal (block enable signal shown in FIG. 1D) is three times that of the normal double-pulse signal (block enable signal shown in FIG. 1A).

More specifically, as shown in FIG. 1D, in the decimation (n=3) mode, the pulse signal (P1=0.0, P2=0.0, and P3=0.1 μsec) of the first block, the pulse signal (P1=0.0, P2=0.1 μsec, and P3=0.4 μsec) of the second block, and the pulse signal (P1=0.0, P2=0.0 μsec, and P3=1.0 μsec) of the third block, which are successive as shown in FIG. 12A, are combined (synthesized) into one pulse signal.

This synthesized pulse signal can ensure an idle time longer than that for normal double pulses. A bubbling energy (P3+P3+P3=0.1+0.4+1=1.5 μsec) larger than a normal one can be obtained.

The printhead temperature is 40° C. or more, which is higher than 30° C. or less in normal double-pulse processing. The discharge amount per droplet increases to about 11 pl.

The number of blocks used is ⅓ that of normal double-pulse processing because only four nozzles in accordance with blocks 0, 3, 6, and 9 are used, as shown in FIG. 2C.

The ink discharge amount (one droplet) from each nozzle shown in FIG. 2C is about 11 pl. The ink discharge amount (12 droplets) in an image area printed using 12 nozzles of blocks 2 to 11 shown in FIG. 2C is 11 pl×12 droplets=132 pl.

This ink discharge amount (132 pl) is 132/216=0.61, i.e., 61% of the ink discharge amount (216 pl) in the same image area in normal double- or single-pulse processing of FIG. 2A or 2B.

That is, printing the same image area (predetermined area) shown in FIG. 2A in decimation (n=3) mode processing can reduce the ink consumption used in normal double- or single-pulse processing by 39%.

In the example of the decimation (n=3) mode shown in FIG. 1D, the first one of three successive blocks is used, and the second and third blocks are decimated (e.g., of blocks 0, 1, and 2, block 0 is used, and blocks 1 and 2 are decimated). A block to be decimated is not limited to this, and of three successive blocks, the first and second blocks or the first and third blocks may be decimated.

As described above, an ink amount (e.g., image area shown in FIG. 2A) used to print a predetermined area is detected. A printing mode (e.g., decimation (n=3) mode processing) corresponding to the ink amount used to print the predetermined area can be selected to print an image.

A conventional control method prints an image by using normal double-pulse processing or the like even when the printhead temperature greatly rises to 40° C. or more (e.g., when high-density image printing is to be performed). The ink discharge amount increases, and ink overflows from printed pixels, or ink blur or inter-color blur (bleed) occurs. As a result, the image quality degrades, which cannot be prevented by the conventional control method. The use of the above decimation (n=3) mode processing can solve the problem of the conventional control method. Even if the ink consumption is suppressed, printing degradation hardly occurs, and the printing quality can be greatly improved.

The first embodiment has described a driving example on one nozzle line using one color ink. The present invention can also be applied to printing of a color image using a plurality of inks.

In printing a color image using a plurality of inks, different block data are transferred for respective ink colors while the above-described control method is employed. By changing the driving control contents, the image printing quality can be improved.

The effects can be further enhanced by finely controlling switching between the three printing modes every block.

For example, in the first embodiment, blocks 0 and 1 can be controlled to the decimation mode (n=2); blocks 3 and 4, to the normal single-pulse mode; and blocks 5, 6, and 7, to the decimation mode (n=3).

Second Embodiment

An image printing control method according to the second embodiment will be described.

The hardware arrangement of an ink-jet printer which adopts the following image printing control method of the second embodiment is the same as that of the ink-jet printer described in the first embodiment with reference to FIGS. 4, 10, 11, 13, and 14.

In the description of the second embodiment, a description of the hardware arrangement of the ink-jet printer will be omitted, and only the image printing control method of the second embodiment installed in the ink-jet printer will be explained.

In the second embodiment, the same reference numerals as in the first embodiment denote the same parts, a description thereof will be omitted, and only a difference will be explained.

The image printing control method executed under the control of a CPU 163 will be explained with reference to FIGS. 1A, 1B, 1C, 1D, 2A, 2B, 2C, 11, 12A, 12B, 17, 18, and 19.

FIGS. 1A, 1B, 1C, and 1D are timing charts of image printing. FIGS. 2A, 2B, and 2C are views showing the size and line of discharge dots when an image is printed as shown in FIGS. 1A, 1B, 1C, and 1D.

FIG. 11 is a block diagram showing a control arrangement for executing printing control of the ink-jet printer. FIG. 12A is a table showing the pulse widths of pulses P1, P2, and P3 in four processes in a driving pulse width table. FIG. 12B is a timing chart for explaining the first, second, and third block pulses P1, P2, and P3. These drawings have been described in the first embodiment, a repetitive description thereof will be omitted, and only FIGS. 17 to 19 will be explained.

FIG. 17 shows a printhead—printing mode table in the second embodiment.

Figure 18:
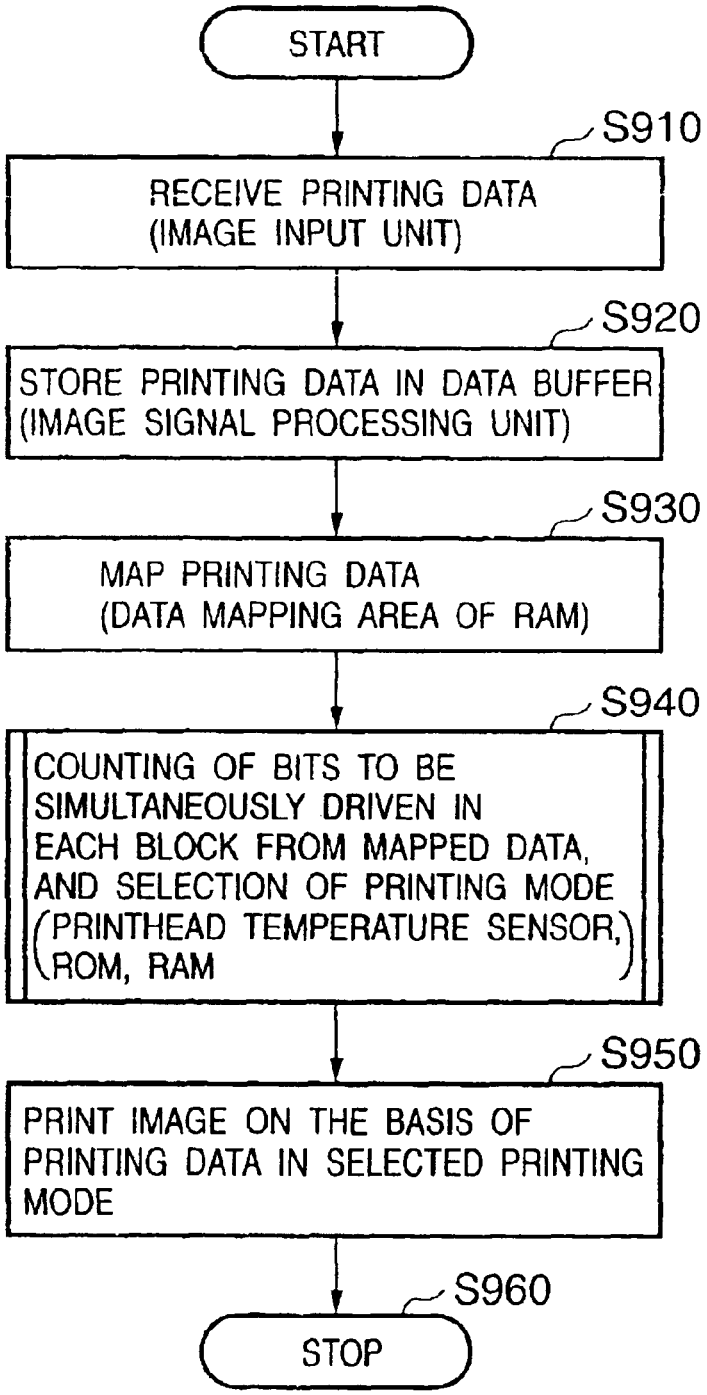
FIG. 18 is a flow chart for explaining an image printing control method according to the second embodiment of the present invention.
Figure 19:
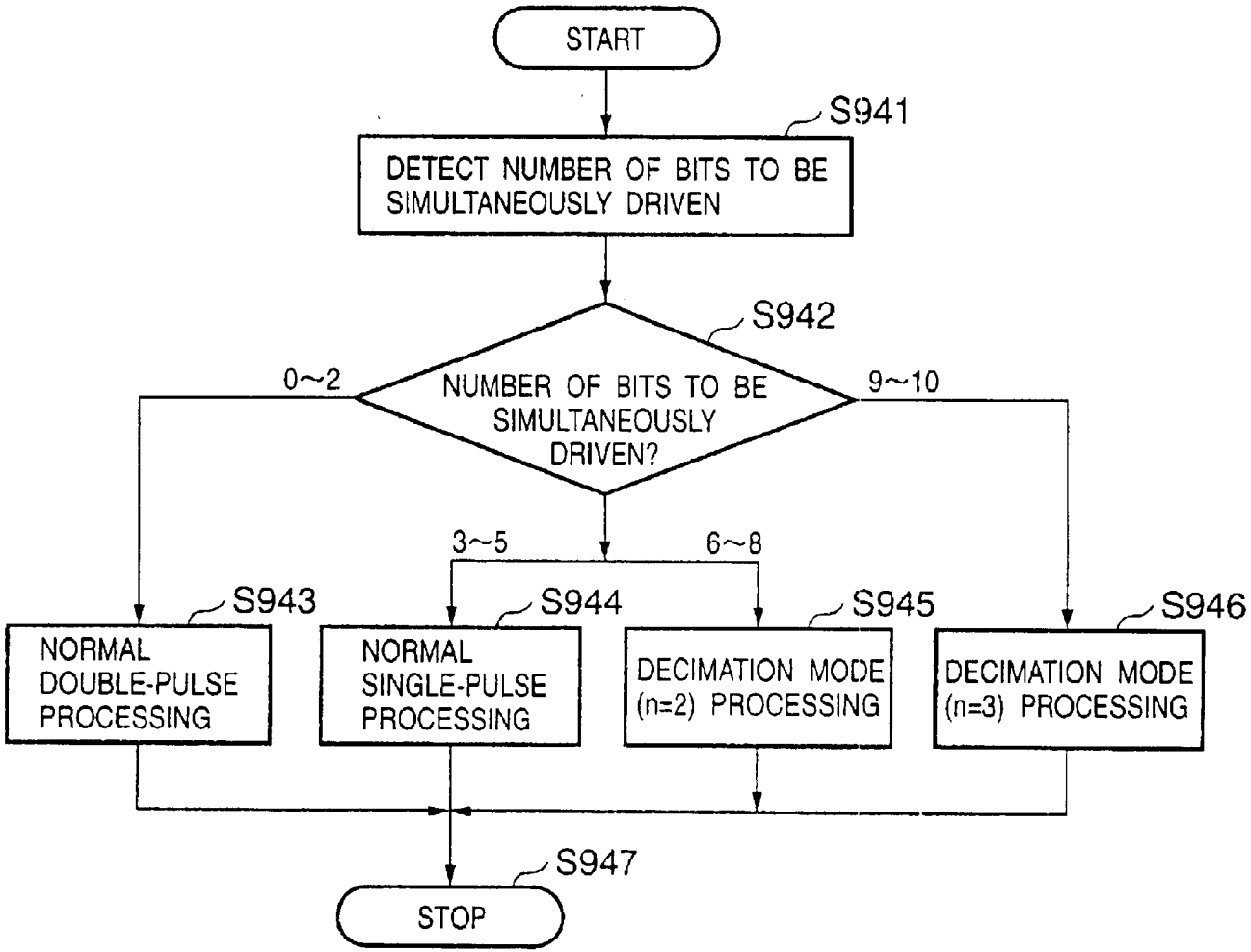
FIG. 19 is a flow chart for explaining a printing mode selection method according to the second embodiment of the present invention.

FIGS. 18 and 19 are flow charts for explaining the image printing control method in the second embodiment.

In the following description, image printing using an ink tank of one color will be explained for descriptive convenience.

The image printing control method will be described with reference to FIGS. 18 and 19.

An image input unit 161 in a standby state receives a printing data signal in step S910, and then the flow shifts to step S920. An image signal processing unit 166 stores the printing data signal in a data buffer.

In step S930, the printing data signal temporarily stored in the image signal processing unit 166 is mapped in a data mapping area 165*a* of a RAM 165.

In step S940, a simultaneous driving bit counter 170 counts, from the mapped data, bits to be simultaneously driven in each block of one column. A printing mode corresponding to the counted number of bits to be simultaneously driven is selected in accordance with the table of FIG. 17.

Processing in step S940 will be described in detail with reference to FIG. 19. More specifically, the number of bits to be simultaneously driven is detected in step S941, and then the flow advances to step S942 to select a printing mode corresponding to the detected number of bits to be simultaneously driven.

If the number of bits to be simultaneously driven is 0 to 2, the flow shifts to step S943 to select normal double-pulse processing. A pulse width for driving each block is set by looking up the normal double driving table of a ROM 164 that corresponds to the selected printing mode. The set pulse width is written in a set pulse width area 165*c*.

If the number of bits to be simultaneously driven is 3 to 5, the flow shifts to step S944 to select normal single-pulse processing. A pulse width for driving each block is set by looking up the normal single-pulse driving table of the ROM 164 that corresponds to the selected printing mode. The set pulse width is written in the set pulse width area 165*c*.

If the number of bits to be simultaneously driven is 6 to 8, the flow shifts to step S945 to select decimation mode (n=2) processing. A pulse width for driving each block is set by looking up the decimation mode (n=2) driving table of the ROM 164 that corresponds to the selected printing mode. The set pulse width is written in the set pulse width area 165*c*.

If the number of bits to be simultaneously driven is 9 or 10, the flow shifts to step S946 to select decimation mode (n=3) processing. A pulse width for driving each block is set by looking up the decimation mode (n=3) driving table of the ROM 164 that corresponds to the selected printing mode. The set pulse width is written in the set pulse width area 165*c*.

In step S950, a printhead unit 167 prints an image on the basis of printing data in the selected printing mode. The flow advances to step S960 to end a series of operations.

[Printing Mode and Driving Pulse]

Driving pulses in the four driving modes described above (normal double-pulse processing, normal single-pulse processing, decimation mode (n=2) processing, and decimation mode (n=3) processing), using different numbers of bits to be simultaneously driven in the second embodiment are the same as those described in the first embodiment with reference to FIGS. 1A, 1B, 1C, 1D, 2A, 2B, and 2C. A repetitive description of driving pulses will be omitted.

The second embodiment has described a driving example on one nozzle line using one color ink. The present invention can also be applied to printing of a color image using a plurality of inks.

In printing a color image using a plurality of inks, different block data are transferred for respective ink colors while the above-described control method is employed. By changing the driving control contents, the image printing quality can be improved.

The effects can be further enhanced by finely controlling switching between the four printing modes every block.

For example, in the second embodiment, blocks 0 and 1 can be controlled to the decimation mode (n=2); blocks 3 and 4, to the normal single-pulse mode; and blocks 5, 6, and 7, to the decimation mode (n=3).

In the above embodiments, droplets discharged from the printhead are ink droplets, and a liquid stored in the ink tank is ink. However the liquid to be stored in the ink tank is not limited to ink. For example, a treatment solution to be discharged onto a printing medium so as to improve the fixing property or water resistance of a printed image or its image quality may be stored in the ink tank.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of a so-called on-demand type and continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printing head, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printing head, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printing head having a length corresponding to the width of a maximum printing medium which can be printed by the printer, either the arrangement which satisfies the full-line length by combining a plurality of printing heads as disclosed in the above specification or the arrangement as a single printing head obtained by forming printing heads integrally can be used.

In addition, not only an exchangeable chip type printing head, as described in the above embodiment, which can be electrically connected to the apparatus main unit and can receive an ink from the apparatus main unit upon being mounted on the apparatus main unit but also a cartridge type printing head in which an ink tank is integrally arranged on the printing head itself can be applicable to the present invention.

It is preferable to add recovery means for the printing head, preliminary auxiliary means, and the like provided as an arrangement of the printer of the present invention since the printing operation can be further stabilized. Examples of such means include, for the printing head, capping means, cleaning means, pressurization or suction means, and preliminary heating means using electrothermal transducers, another heating element, or a combination thereof. It is also effective for stable printing to provide a preliminary discharge mode which performs discharge independently of printing. Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printing head or by combining a plurality of printing heads.

The present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium storing program code for performing the aforesaid processes to a computer system or apparatus (e.g., a personal computer), reading the program code, by a CPU or MPU of the computer system or apparatus, from the storage medium, then executing the program. In this case, the program code read from the storage medium realize the functions according to the embodiments, and the storage medium storing the program code constitutes the invention.

Further, the storage medium, such as a floppy disk, a hard disk, an optical disk, a magneto-optical disk, a CD-ROM, a CD-R, a magnetic tape, a non-volatile type memory card, and a ROM, can be used for providing the program code.

Furthermore, additional functions according to the above embodiments are realized by executing the program code, which are read by a computer. The present invention includes a case where an OS (operating system) or the like working on the compute performs a part of or an entire process in accordance with designations of the program code and realizes functions according to the above embodiments.

Furthermore, the present invention also includes a case where, after the program code read from the storage medium are written in a function expansion card which is inserted into the computer or in a memory provided in a function expansion unit which is connected to the computer, a CPU or the like contained in the function expansion card or function expansion unit performs a part of or an entire process in accordance with designations of the program code and realizes functions of the above embodiments.

When the present invention is applied to the storage medium, the storage medium stores program codes corresponding to the above-described flow charts (shown in FIGS. 15, 16, 18, and 19).

As is apparent from the above description, according to the present invention, pulses are controlled in a few multiples of block times so as to form one dot by at least two successive blocks when the temperature rises, an image with a high duty is to be printed, or the pulse width increases under the control of a voltage drop. While data is decimated, the discharge amount and landing position are appropriately controlled. Even in high-speed driving, decimation and printing can be easily achieved. In addition, the landing ink amount, control of the discharge amount, and the landing position can be further optimized, realizing highly efficient printing.

In an ink-jet printer which controls the pulse width in accordance with changes in the heater resistance and wiring resistance of the printhead, variations in nozzle precision, discharge variations in printing elements, and changes in voltage drop, the waveform and the driving energy with respect to the critical bubbling energy are changed in accordance with the controlled pulse width, thus ensuring stable discharge.

Printing elements to be simultaneously driven in each block are counted, and the divisional driving pulse width is controlled in accordance with a simultaneous driving count output. Accordingly, there can be provided a high-durability, high-reliability ink-jet printer without any variations in discharge amount caused by a voltage drop or any discharge error at a high driving frequency, and a printing method.

As has been described above, the present invention can provide an image printing apparatus capable of high-quality, high-efficiency printing by optimizing the number of blocks for discharging ink and the ink discharge amount in accordance with a rise in printhead temperature or the number of printing elements to be simultaneously driven even when the printhead temperature rises or high-density printing is to be performed in driving the printhead at a high speed, and a control method therefor.

As many apparently widely different embodiments of the present invention can be made without departing from the spirit and scope thereof, it is to be understood that the invention is not limited to the specific embodiments thereof except as defined in the claims.

What is claimed is:

1. An image printing apparatus for driving a plurality of blocks by using a plurality of divided periods by time division to print an image, each block having a predetermined number of printing elements grouped from a plurality printing elements, comprising:

first driving means for driving the plurality of blocks by time division by supplying a main pulse for discharging ink from printing elements of a block every divided period;

second driving means for selecting blocks to drive, a number of which is less than a total number of blocks, and driving each of the selected blocks to drive by time division by supplying a main pulse for discharging ink from printing elements of a block during one of the divided periods, and supplying at least one preheating pulse for preheating the printing elements of the block but not to discharge ink during at least one other of the divided periods; and image printing means for selecting either one of said first and second driving means, and printing the image using the selected driving means.

2. The apparatus according to claim 1, wherein a number of the divided periods is two.

3. The apparatus according to claim 2, wherein said second driving means performs one ink discharging using the at least one preheating pulse and the main pulse in successive divided periods.

4. The apparatus according to claim 2, wherein the image printing means selects either one of first and second driving means in accordance with a temperature of a printhead.

* * * * *

UNITED STATES PATENT AND TRADEMARK OFFICE

CERTIFICATE OF CORRECTION

PATENT NO. : 6,871,927 B2
DATED : March 29, 2005
INVENTOR(S) : Oikawa

It is certified that error appears in the above-identified patent and that said Letters Patent is hereby corrected as shown below:

Column 7,
Line 30, “reciprocate” should read -- reciprocal --.

Column 16,
Line 47, “realize” should read -- realizes --.
Line 63, “are” should read -- is --.

Column 18,
Line 13, “printing” should read -- of printing --.

Signed and Sealed this

Twentieth Day of December, 2005

JON W. DUDAS
*Director of the United States Patent and Trademark Office*